US009646572B2

(12) United States Patent
Yamada et al.

(10) Patent No.: US 9,646,572 B2
(45) Date of Patent: May 9, 2017

(54) IMAGE PROCESSING APPARATUS

(71) Applicant: FUJITSU TEN LIMITED, Kobe-shi, Hyogo (JP)

(72) Inventors: Masahiro Yamada, Kobe (JP); Shinichi Moriyama, Kobe (JP); Ryuichi Morimoto, Kobe (JP); Miki Murasumi, Kobe (JP)

(73) Assignee: FUJITSU TEN LIMITED, Kobe (JP)

( * ) Notice: Subject to any disclaimer, the term of this patent is extended or adjusted under 35 U.S.C. 154(b) by 291 days.

(21) Appl. No.: 14/222,986

(22) Filed: Mar. 24, 2014

(65) Prior Publication Data

US 2014/0292805 A1 Oct. 2, 2014

(30) Foreign Application Priority Data

Mar. 29, 2013 (JP) ..... 2013-073557

(51) Int. Cl.
*G09G 5/377* (2006.01)
*G09G 5/00* (2006.01)
(Continued)

(52) U.S. Cl.
CPC ..... *G09G 5/377* (2013.01); *G09G 5/00* (2013.01); *G09G 2340/10* (2013.01);
(Continued)

(58) Field of Classification Search
CPC ..... G06T 15/503; G09G 2340/10; G06K 9/00791; B60R 11/04; B60R 2300/105; B60R 2300/302; B60R 2300/305; B60R 2300/60; B60R 2300/8006; B60R 2300/802
(Continued)

(56) References Cited

U.S. PATENT DOCUMENTS 7,212,653 B2 * 5/2007 Sato ..... H04N 7/183 348/E7.087
2002/0167589 A1 * 11/2002 Schofield ..... B60N 2/002 348/148
(Continued)

FOREIGN PATENT DOCUMENTS

JP H09-50541 A 2/1997
JP 2003196645 A 7/2003
(Continued)

OTHER PUBLICATIONS

Bollinger, Susan A., et al. "Grinline identification using digital imaging and Adobe Photoshop." Journal of forensic sciences 54.2 (2009): 422-427.*
(Continued)

*Primary Examiner* — Ulka Chauhan
*Assistant Examiner* — Sae Won Yoon
(74) *Attorney, Agent, or Firm* — Oliff PLC

(57) ABSTRACT

An image processing apparatus determines a transparency percentage of each of plural portions of a cabin image of a vehicle, causes the plural portions to be semi-transparent or to be transparent at the determined transparency percentages and displays the cabin image. Thus, the user can intuitively understand a positional relationship between the vehicle and a surrounding region and does not miss an obstacle in a course of traveling of the vehicle.

16 Claims, 25 Drawing Sheets

(51) Int. Cl.
*H04N 1/32* (2006.01)
*G06F 3/00* (2006.01)
*H04N 5/217* (2011.01)

(52) U.S. Cl.
CPC ..... *G09G 2340/12* (2013.01); *G09G 2354/00* (2013.01); *G09G 2380/10* (2013.01)

(58) Field of Classification Search
USPC ..... 345/592, 629; 348/118, 135, 148
See application file for complete search history.

(56) References Cited

U.S. PATENT DOCUMENTS

2005/0078325 A1* 4/2005 Momose ..... H04N 1/3872 358/1.9
2005/0231532 A1* 10/2005 Suzuki ..... G06F 3/012 345/633
2008/0049150 A1* 2/2008 Herbin ..... B60Q 9/00 348/744
2008/0109751 A1* 5/2008 Fitzmaurice ..... G06F 3/0488 715/793
2008/0246843 A1* 10/2008 Nagata ..... B60R 1/00 348/148
2010/0289634 A1* 11/2010 Ikeda ..... B60Q 9/005 340/441
2010/0315413 A1* 12/2010 Izadi ..... G06F 3/017 345/419
2011/0001751 A1* 1/2011 Carlsson ..... G09B 29/102 345/419
2011/0043632 A1* 2/2011 Satoh ..... B60R 1/00 348/148
2011/0307176 A1* 12/2011 Sun ..... G08G 1/168 701/301
2012/0113261 A1* 5/2012 Satoh ..... B60R 1/00 348/148
2012/0242834 A1* 9/2012 Satoh ..... B60R 1/00 348/148
2012/0249584 A1* 10/2012 Naruse ..... G06T 11/60 345/629
2012/0249789 A1* 10/2012 Satoh ..... G06K 9/00805 348/143
2012/0327238 A1* 12/2012 Satoh ..... B60R 1/00 348/148
2013/0135235 A1* 5/2013 Noutomi ..... G06F 3/041 345/173
2013/0300872 A1* 11/2013 Park ..... B60R 1/00 348/148

FOREIGN PATENT DOCUMENTS

JP 2010-114618 A 5/2010
JP A-2010-109684 5/2010
JP 2011-023805 A 2/2011
JP 2011188335 A 9/2011
WO 2009-104675 A1 8/2009

OTHER PUBLICATIONS

Partial translation of Oct. 18, 2016 Office Action issued in Japanese patent application No. 2013-073557.

* cited by examiner

IMAGE PROCESSING APPARATUS

BACKGROUND OF THE INVENTION

Field of the Invention

The invention relates to a technology that is used to process images showing surroundings of a vehicle.

Description of the Background Art

Conventionally, systems that combine captured images of surroundings of a vehicle and others and that display images showing the surroundings of the vehicle viewed from a driver seat are known. A user (typically a driver) can see the surroundings of the vehicle by using such a system, even in a cabin of the vehicle.

Recently, there is a known technology that superimposes a cabin image of a cabin viewed from a driver seat on an image showing surroundings of a vehicle and that displays the entire cabin image in a transparent or semi-transparent form and also even an obstacle hidden behind a body of the vehicle in visual contact. The user can see such an image and can recognize an object located in the surroundings of the vehicle, understanding a positional relationship between the vehicle and the surroundings of the vehicle.

However, if the entire cabin image is displayed in the transparent or semi-transparent form, various objects are displayed on the transparent or semi-transparent portion of the cabin. Therefore, the user cannot immediately determine an object requiring a closest attention in an image showing the surroundings. In this case, although an obstacle is displayed in the course of traveling, there has been a possibility that the user may miss the obstacle.

SUMMARY OF THE INVENTION

According to one aspect of the invention, an image processing apparatus configured to be used on a vehicle includes: (a) an image processor configured to (i) generate a surrounding image showing a surrounding region of the vehicle viewed from a virtual viewpoint located in the vehicle, by using an image captured by a camera mounted on the vehicle; (ii) obtain a vehicle image that is divided into plural portions showing the vehicle viewed from the virtual viewpoint; (iii) generate a combined image by combining the surrounding image and the vehicle image having the plural portions; and (iv) output the combined image for display on a display apparatus, and (b) a controller configured to determine a transparency percentage of each of the plural portions of the vehicle image. The image processor causes the plural portions to be semi-transparent or to be transparent at the determined transparency percentages such that the combined image includes the surrounding image and the vehicle image having the plural portions caused to be semi-transparent or to be transparent at the determined transparency percentages.

Since the image processing apparatus causes the plural portions into which the vehicle image is divided to be semi-transparent or to be transparent, the user can intuitively understand a positional relationship between the vehicle and a surrounding region of the vehicle.

According to another aspect of the invention, an image processing apparatus configured to be used on a vehicle includes: (a) an image processor configured to (i) generate a surrounding image showing a surrounding region of the vehicle viewed from a virtual viewpoint located in the vehicle, by using an image captured by a camera mounted on the vehicle; (ii) obtain a vehicle image that is divided into plural portions showing the vehicle viewed from the virtual viewpoint; (iii) generate a combined image by combining the surrounding image and the vehicle image having the plural portions; and (iv) output the combined image for display on a display apparatus, and (b) a controller configured to determine a transparency percentage of each of the plural portions of the vehicle image. The image processor causes the plural portions to be semi-transparent or to be transparent at the determined transparency percentages such that the combined image includes the surrounding image and the vehicle image having the plural portions caused to be semi-transparent or to be transparent at the determined transparency percentages, and the plural portions overlap each other when the surrounding region is viewed from the virtual viewpoint.

Since the image processing apparatus causes the plural portions into which the vehicle image is divided to be semi-transparent or to be transparent and the plural portions overlap each other when the surrounding region is viewed from the virtual viewpoint. Thus, the user can intuitively understand a positional relationship between the vehicle and the surrounding region of the vehicle.

Therefore, an object of the invention is to enable a user to intuitively understand a subject by displaying a surrounding image superimposed on a cabin image caused to be semi-transparent or to be transparent.

These and other objects, features, aspects and advantages of the invention will become more apparent from the following detailed description of the invention when taken in conjunction with the accompanying drawings.

DESCRIPTION OF THE EMBODIMENTS

An embodiment of the invention is hereinafter explained with reference to the drawings.

1. First Embodiment

<1-1. Outline>

Figure 1:
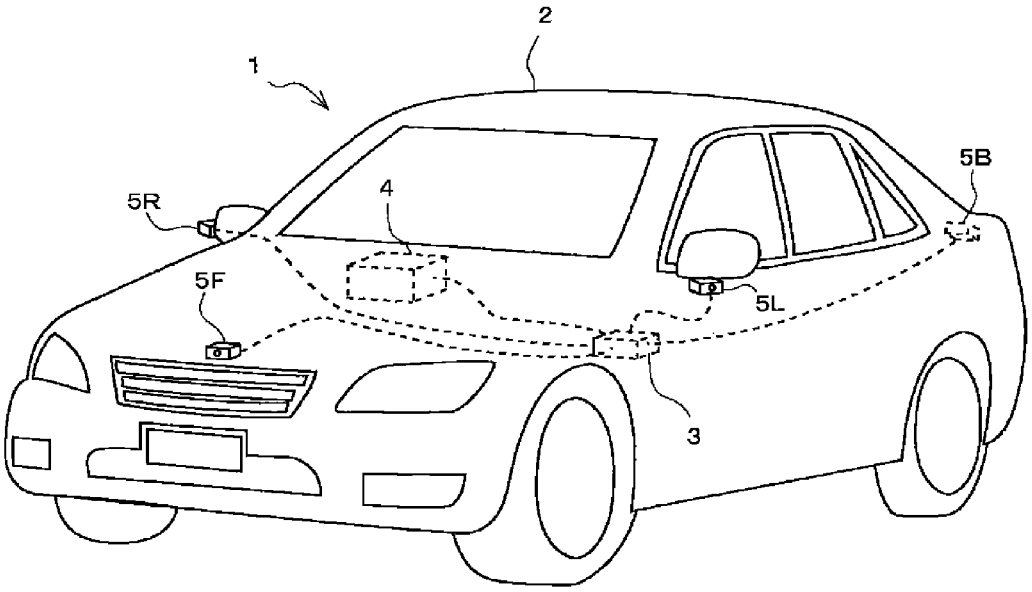
FIG. 1 shows an outline of an image processing system.

FIG. 1 shows an outline of an image processing system 1 in the embodiment of the invention. The image processing system 1 combines a cabin image showing an inside of a cabin of a vehicle 2 at a transparency percentage increased by an image processing apparatus 3 of images captured by plural cameras 5 (5F, 5B, 5L, and 5R) installed on the vehicle 2, the combined image for display on a display apparatus 4.

The cabin image is divided into plural portions. The image processing apparatus 3 determines the transparency percentage for each of the plural portions of the cabin image and causes each portion to be transparent or to be semi-transparent (hereinafter referred to collectively as transparent) at the determined transparency percentage.

The image processing apparatus 3 combines surrounding images AP obtained by the plural cameras 5 with the cabin image having the portions transparent at the determined transparency percentages, and generates the combined image.

Figure 2:
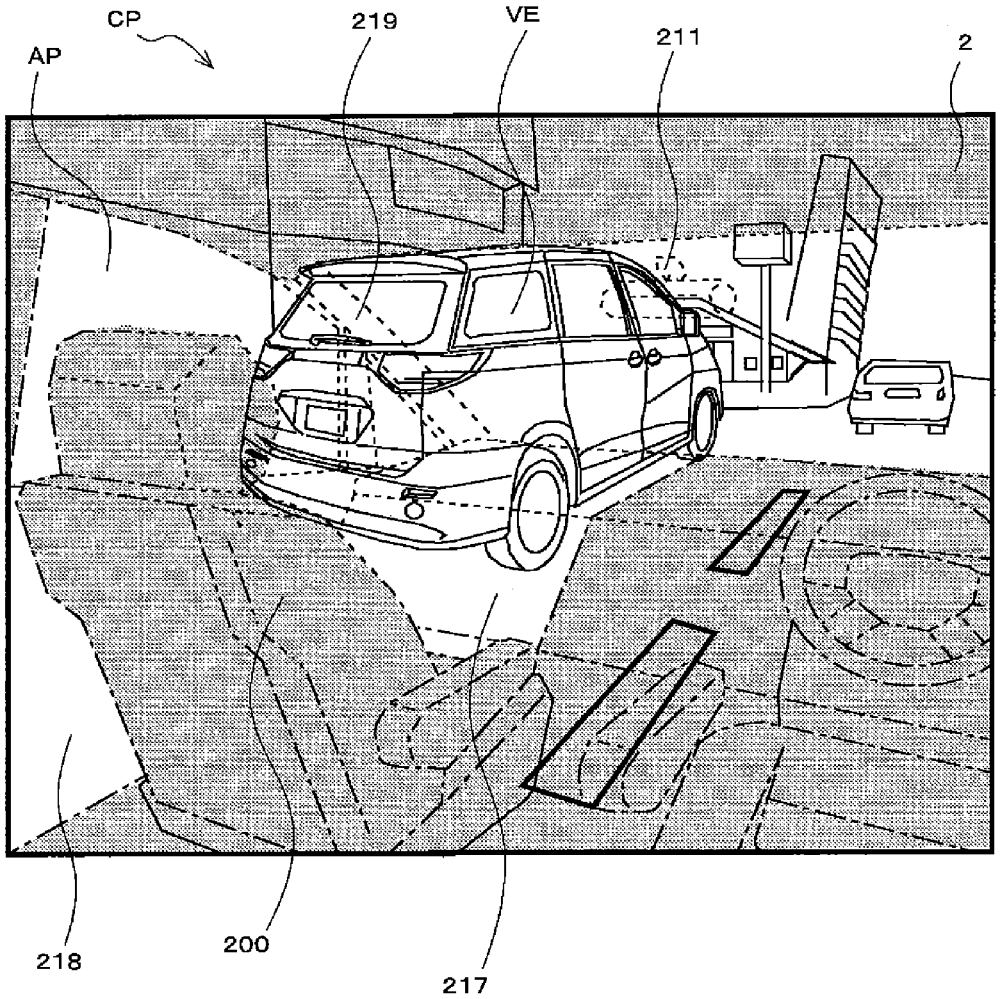
FIG. 2 shows an outline of the image processing system.

FIG. 2 shows an example of a combined image CP. The combined image CP shows a left front view from a viewpoint of a user in the vehicle 2 passing by a parked vehicle VE. A cabin image 200 is superimposed on the surrounding image AP including the parked vehicle VE and others. Among the plural portions into which the cabin image 200 is divided, portions overlapping with the parked vehicle VE from the viewpoint of the user are displayed at a higher transparency percentage than other portions. In other words, among objects shown on the cabin image 200, a left dashboard 217, a left door panel 218, a left front pillar 219, and a rearview mirror 211 are displayed at the higher transparency percentage than the other portions. Thus, the user can intuitively understand a positional relationship between a vehicle parked near the host vehicle and the host vehicle by seeing the combined image CP generated based on the viewpoint of the user and can pass by the parked vehicle VE safely.

In the embodiment, the plural "portions" into which the cabin image 200 is divided include "parts" that consist of the vehicle and that are physically independent of one another. Examples of the parts are a body and a door panel. Moreover, each of the "parts" is composed of separable "regions." For example, the body can be separated into a roof, a pillar, a fender and other regions. Therefore, the roof, the pillar, the fender and the others regions of the body are also included in the "portions" as separate regions. The same holds true for the dashboard and parts other than the body that consist of the vehicle. Therefore, in this embodiment, the portions into which the cabin image 200 is divided may be referred to as "parts" or "regions."

<1-2. Configuration>

Figure 3:
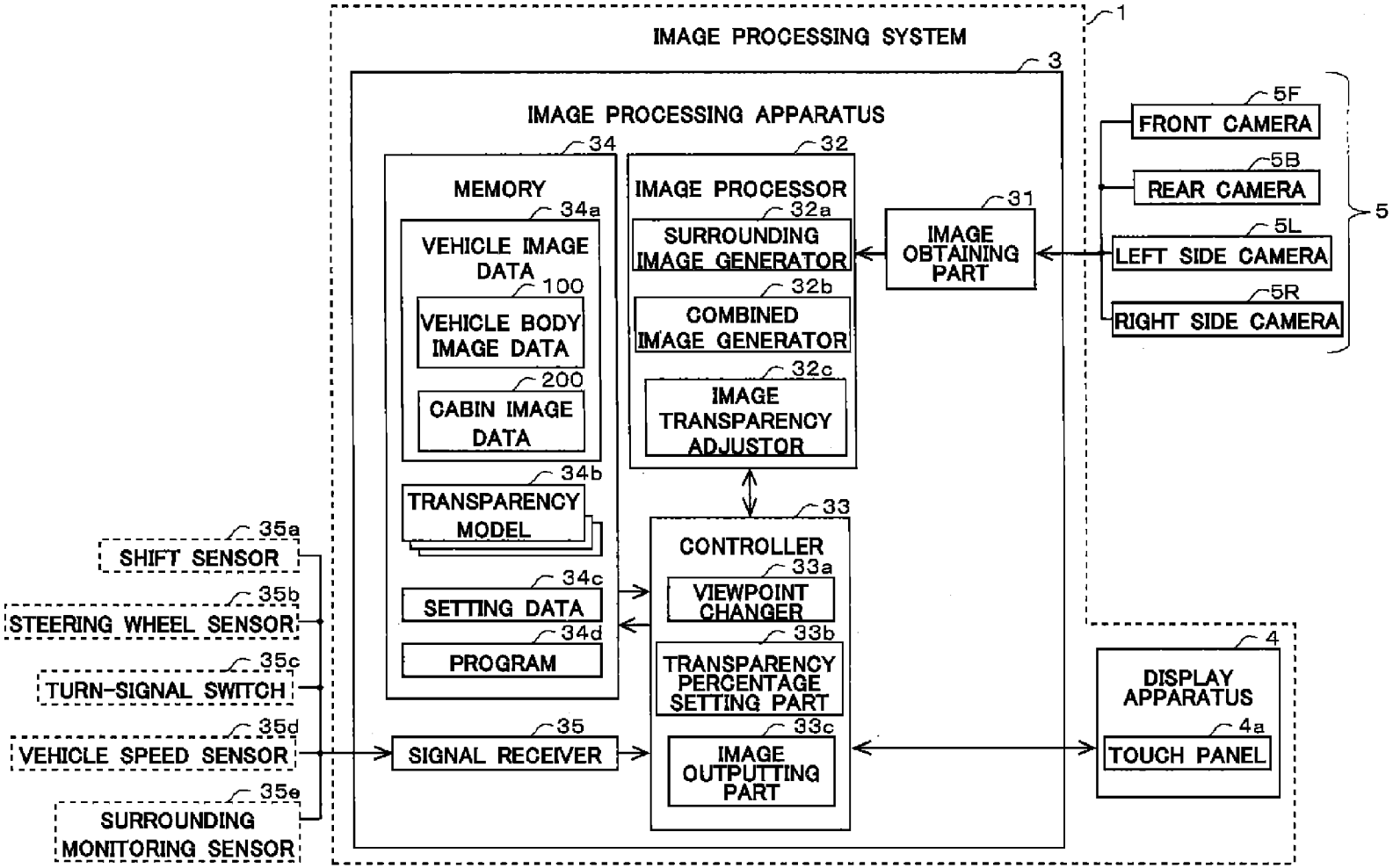
FIG. 3 shows a configuration of the image processing system.

FIG. 3 shows a configuration of the image processing system 1 in a first embodiment. The image processing system 1 is mounted on the vehicle 2 such as a car. The image processing system 1 generates an image showing the surroundings of the vehicle 2 and shows the generated image to the user in the cabin.

The image processing system 1 includes the image processing apparatus 3 and the display apparatus 4. Moreover, the image processing apparatus 3 includes the plural cameras 5 that capture the images showing the surroundings of the vehicle 2.

The image processing apparatus 3 performs a variety of image processing, using the captured images and generates an image to be displayed on the display apparatus 4. The display apparatus 4 displays the image generated and output by the image processing apparatus 3.

Each of the plural cameras 5 (5F, 5B, 5L and 5R) includes a lens and an image sensor. The plural cameras 5 capture the images showing the surroundings of the vehicle 2 and obtain the captured images electronically. The plural cameras 5 include a front camera 5F, a rear camera 5B, a left side camera 5L and a right side camera 5R. The plural cameras 5 are disposed at positions different from one another on/in the vehicle 2 and capture the images from the vehicle 2 in directions different from one another.

Figure 4:
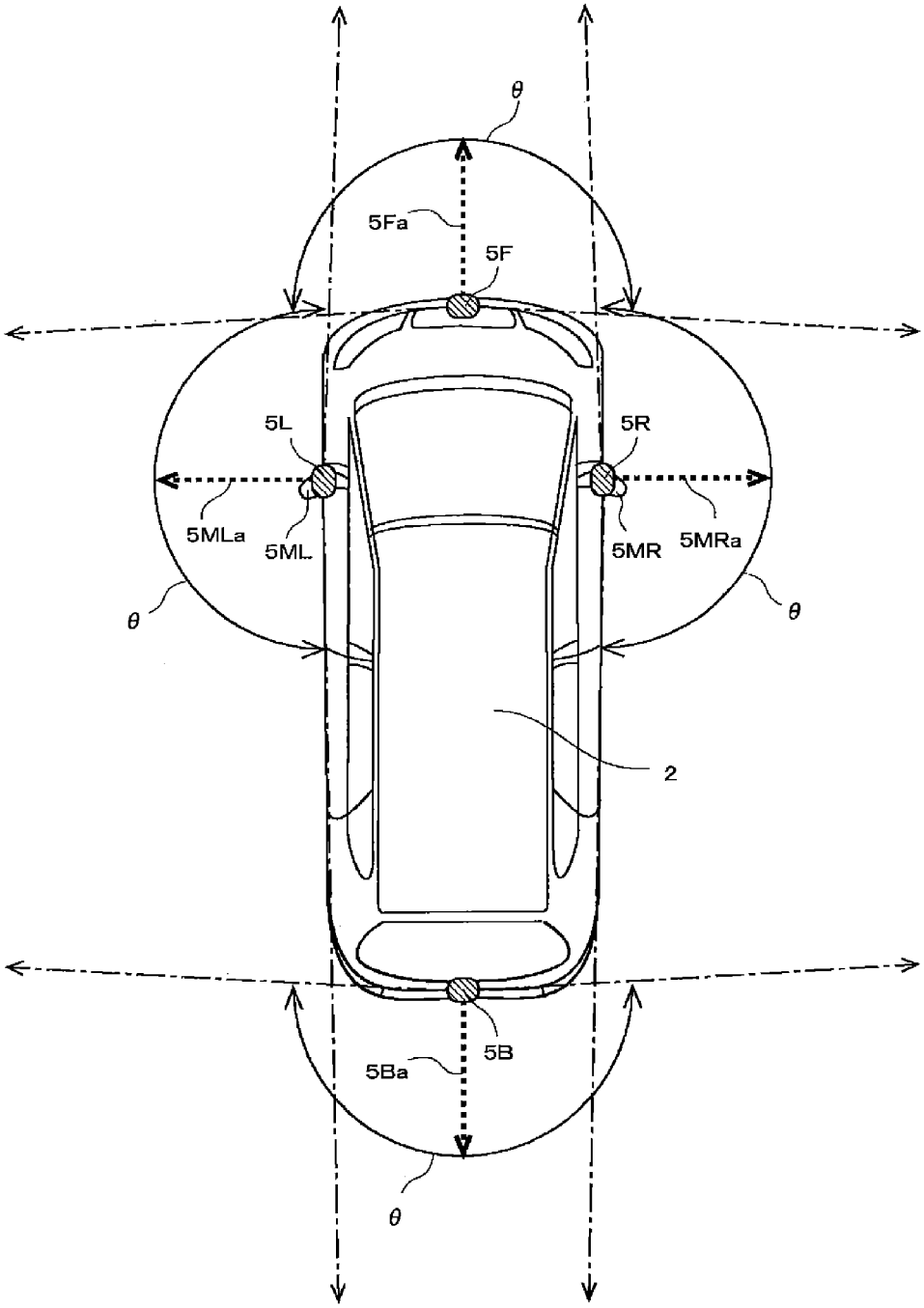
FIG. 4 shows installation positions of vehicle-mounted cameras.

FIG. 4 shows the directions in which the plural cameras 5 capture the images. The front camera 5F is disposed at a front end of the vehicle 2 having a light axis 5Fa in a traveling direction of the vehicle 2. The rear camera 5B is disposed at a back end of the vehicle 2 having a light axis 5Ba in a direction opposite to the traveling direction of the vehicle 2, i.e., a backward direction. The left side camera 5L is disposed at a left side door mirror 5ML having a light axis 5MLa in a left direction of the vehicle 2 (direction orthogonal to the traveling direction). The right side camera 5R is disposed at a right side door mirror 5MR having a light axis 5MRa in a right direction of the vehicle 2 (direction orthogonal to the traveling direction).

A wide angle lens, such as a fish lens, is used for each of the plural cameras 5. The wide angle lens has an angle θ of 180 degrees or more. Thus, by using the four cameras 5 are used, the image showing 360-degree surroundings of the vehicle 2 can be captured.

With reference back to FIG. 3, the display apparatus 4 is a display including a thin display panel, such as a liquid crystal display, and a touch panel 4*a* that detects an input operation made by the user. The display apparatus 4 is disposed in the cabin such that the user in a driver seat of the vehicle 2 can see a screen of the display apparatus 4.

The image processing apparatus 3 is an electronic control apparatus that is configured to perform a variety of image processing. The image processing apparatus 3 includes an image obtaining part 31, an image processor 32, a controller 33, a memory 34 and a signal receiver 35.

The image obtaining part 31 obtains the captured image captured by each of the four cameras 5. The image obtaining part 31 has an image processing function, such as A/D conversion that converts an analog captured image to a digital captured image. The image obtaining part 31 performs a predetermined image processing, using the obtained captured image and inputs the processed captured image into the image processor 32.

The image processor 32 is a hardware circuit that performs image processing to generate the combined image. The image processor 32 combines the plural captured images captured by the cameras 5 and generates the surrounding image AP showing the surroundings of the vehicle 2 viewed from a virtual viewpoint. The image processor 32 includes a surrounding image generator 32*a*, a combined image generator 32*b* and an image transparency adjustor 32*c*.

The surrounding image generator 32*a* combines the plural captured images captured by the four cameras 5 and generates the surrounding image AP showing the surroundings of the vehicle 2 from the virtual viewpoint. The virtual viewpoint includes a driver seat viewpoint to look at an outside of the vehicle 2 from the driver seat and an overhead viewpoint to look down at the vehicle 2 from a position of the outside of the vehicle 2.

The combined image generator 32*b* superimposes a vehicle body image 100 or the cabin image 200 of the vehicle 2 on the surrounding image AP generated by the surrounding image generator 32*a*.

The image transparency adjustor 32*c* changes the transparency percentage of the cabin image 200. In other words, the image transparency adjustor 32*c* performs the image processing such that the user can see a part of the surrounding image AP behind the cabin image 200 in a line of sight of the user, through the cabin image 200. In the processing, the image transparency adjustor 32*c* determines the transparency percentage for each of the plural portions of the cabin image 200 and causes the plural portions to be transparent at the determined transparency percentages individually. Here, "causing something to be transparent" means not only causing the cabin image 200 to be transparent on the surrounding image AP (i.e. possible to see the outside of the vehicle from the inside of the vehicle) but also causing the cabin image 200 to be transparent on a different cabin image 200 (i.e. possible to see the inside of the vehicle through an interior, such as a seat, from the vehicle).

The "transparency percentage" is a percentage at which a color of the surrounding image AP goes through a color of the cabin image 200 superimposed on the surrounding image AP, in the line of the sight of the user. Therefore, as the transparency percentage of an image is increased, lines and the color of the image become paler. Thus, the surrounding image AP goes through the cabin image 200 superimposed by the combined image generator 32*b*. For example, when the transparency percentage is set at 50%, the displayed cabin image 200 is pale in color, and the surrounding image AP is displayed through the cabin image 200 pale in color. In other words, the cabin image 200 becomes semi-transparent. When the transparency percentage of the cabin image 200 is set at 100%, the lines and the color of the cabin image 200 are not displayed, and only the surrounding image AP is displayed. On the other hand, when the transparency percentage is set at 0%, the cabin image 200 is displayed in normal color with lines, and a portion of the surrounding image AP overlapped with the cabin image 200 is not displayed.

The change of the transparency percentage is, concretely, a change of a percentage to mix elements of RGB color models of the cabin image 200 and the surrounding image AP. For example, in order to display the cabin image 200 at 50% of the transparency percentage, RGB elements of the cabin image 200 and the surrounding image AP are averaged. Moreover, in order to increase the transparency percentage of the cabin image 200 (i.e. to make the cabin image 200 "paler"), the RGB elements of the surrounding image AP are doubled, the doubled elements are added to the RGB elements of the cabin image 200, and then the summed RGB elements are divided by three. On the other hand, in order to decrease the transparency percentage of the cabin image 200 (i.e. to make the cabin image 200 "darker"), the RGB elements of the cabin image 200 are doubled, the doubled elements are added to the RGB elements of the surrounding image AP, and then the summed RGB elements are divided by three. Moreover, the transparency percentage of an image may be changed by using another well-know image processing method.

The controller 33 is a microcomputer, including a CPU, a RAM and a ROM, that controls the entire image processing apparatus 3. Each function of the controller 33 is implemented by the CPU performing arithmetic processing in accordance with a program stored beforehand. An operation performed by each function included in the controller 33 will be described later.

The memory 34 is a nonvolatile memory, such as a flash memory. The memory 34 stores vehicle image data 34*a*, a transparency model 34*b*, setting data 34*c* and a program 34*d* serving as firmware.

The vehicle image data 34*a* includes the vehicle body image data 100 and the cabin image data 200. The vehicle body image data 100 and the cabin image data 200 include external appearances of the vehicle 2 and images of the cabin of the vehicle 2 viewed from all angles.

The vehicle body image data 100 is an image showing the external appearance of the vehicle 2 viewed from an overhead viewpoint.

The cabin image 200 data is an image showing the cabin viewed from the inside of the vehicle 2, such as the driver seat. Moreover, the cabin image 200 is divided into the plural portions and the each of the plural portions is stored in the memory 34.

Figure 5:
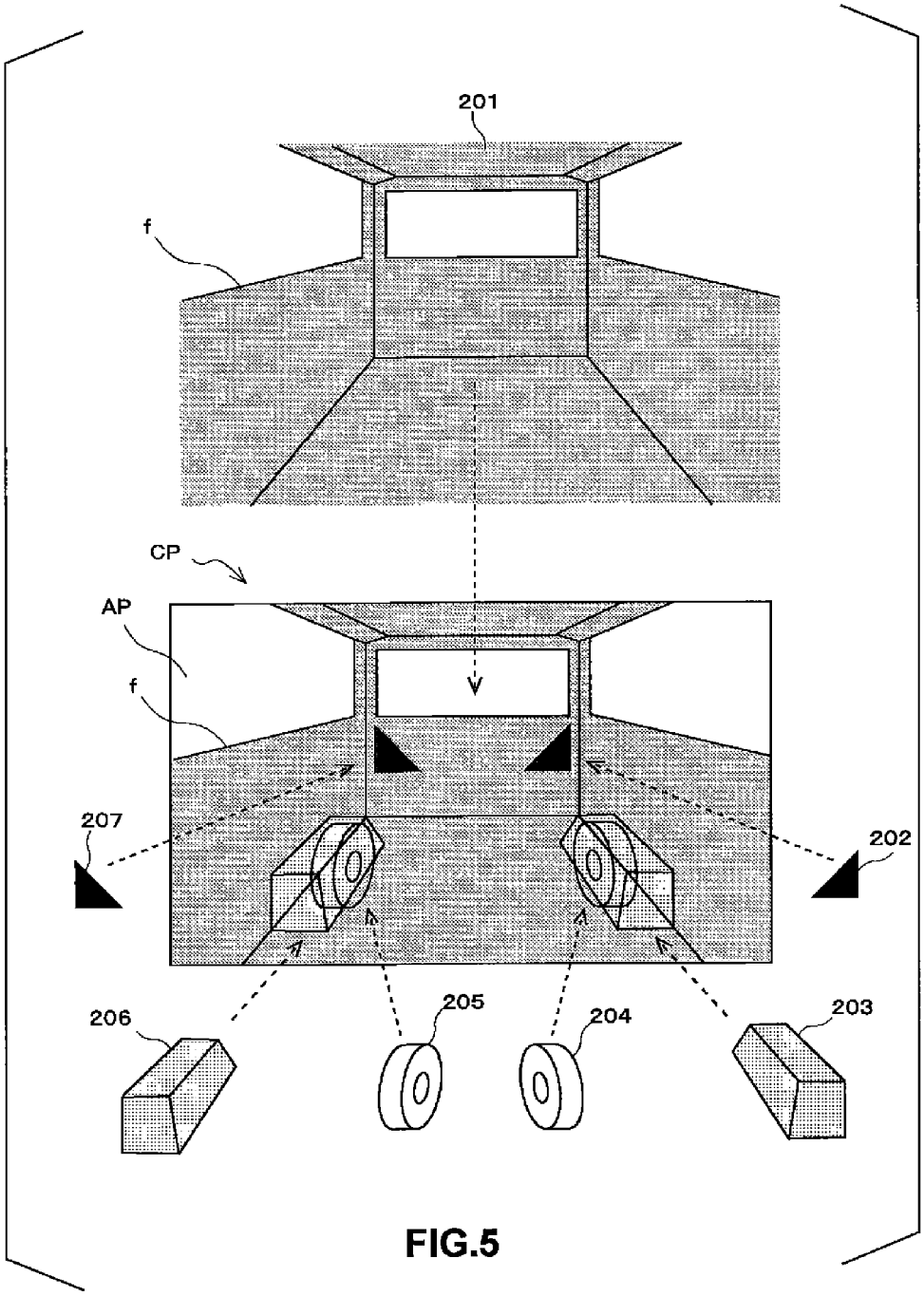
FIG. 5 illustrates a cabin image.
Figure 6:
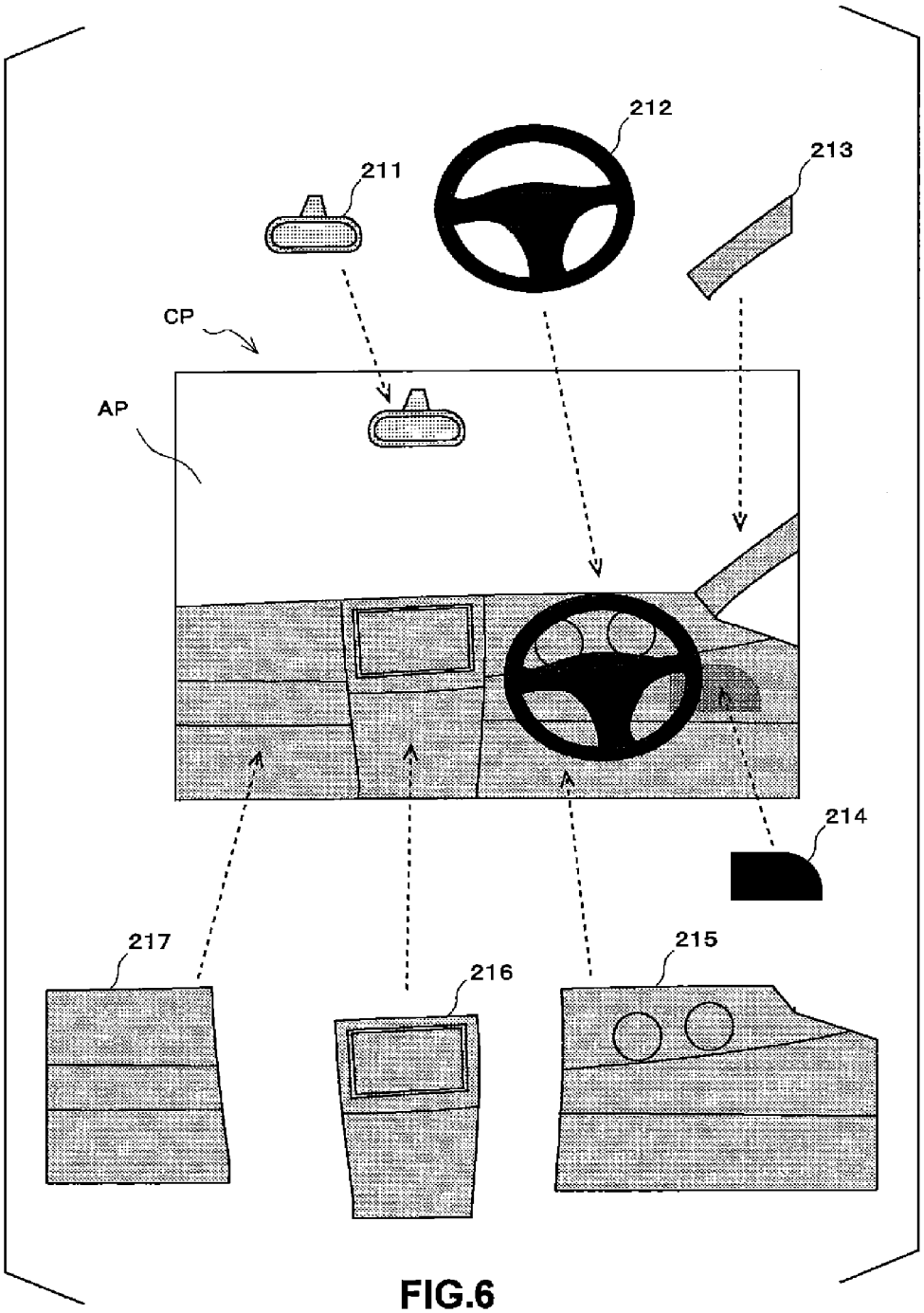
FIG. 6 illustrates a cabin image.

FIG. 5 and FIG. 6 show examples of the generated combined image CP generated by the combined image generator 32*b* by combining the surrounding image AP with the cabin image 200 and then displayed on the display apparatus 4.

FIG. 5 shows the example of the combined image CP generated by the combined image generator 32*b* from a virtual viewpoint that is a viewing position of the user looking rearward of the vehicle 2 in the driver seat. When generating the combined image CP, the combined image generator 32*b* retrieves data of a body image 201, a left tail lamp 202, a left wheel housing 203, a rear left tire 204, a right rear tire 205, a right wheel housing 206 and a right tail lamp 207, as parts of the cabin image 200, from the memory 34. The combined image generator 32*b* places the retrieved plural portions of the cabin image 200 at predetermined positions and superimposes the cabin image 200 on the surrounding image AP.

The plural portions of the cabin image 200 include a frame f showing a shape of the vehicle 2. Moreover, relationships between each viewing position and each view direction of the virtual viewpoints and positions of the plural portions of the cabin image 200 to be displayed may be defined and stored beforehand. Further, instead of the viewing position of the user looking rearward of the vehicle 2 in the driver seat, the viewing position looking rearward of the vehicle from a position of the rearview mirror may be used because when looking rearward of the vehicle, the user looks at an image of a rear side of the vehicle reflected on the rearview mirror.

In addition, in a case of the virtual viewpoint having the viewing position of the user looking rearward of the vehicle 2 in the driver seat, a seat is included in the view. Therefore, the combined image generator 32*b* may further retrieve data of an image of the seat (not illustrated) from the memory 34, may combine the image with the surrounding image AP and then may generate the combined image CP looking rearward of the vehicle where the seat image is placed.

FIG. 6 shows another example of the combined image CP generated by the combined image generator 32*b*. FIG. 6 is the example of the combined image CP generated by the combined image generator 32*b* from a virtual viewpoint having the viewing position of the user looking ahead of the vehicle 2 in the driver seat. The combined image generator 32*b* retrieves data of the rearview mirror 211, a steering wheel 212, a right front pillar 213, a right headlamp 214, a right dashboard 215, a center console 216 and the left dashboard 217, as portions of the cabin image 200, from the memory 34. The combined image generator 32*b* places the retrieved portions of the cabin image 200 at predetermined positions, superimposes the cabin image 200 on the surrounding image AP, and then generates the combined image CP.

With reference back to FIG. 3, the transparency model 34*b* is a model of the cabin image 200 and the transparency percentage of the cabin image 200 is set beforehand for each model. Moreover, the plural transparency models 34*b* are prepared. For example, the transparency models 34*b* are prepared at transparency percentage levels of high, middle and low. In this case, at the middle level, the transparency percentage is set at 50% because it is recommended that the image transparency adjustor 32*c* should set the transparency percentage of the vehicle image data 34*a* at approximately 50%. In other words, since the vehicle image data 34*a* and the surrounding image AP can be seen equally, the user can easily understand a positional relationship between the vehicle 2 and an object located in the surroundings of the vehicle 2.

Moreover, the transparency percentage of the vehicle image data 34*a* may be changed depending on brightness of the surroundings of the vehicle 2. In other words, in a case where illuminance of the surroundings of the vehicle 2 is low, for example at night or in a building without a light, the transparency percentage of the cabin image 200 may be increased to more than 50%. Thus, the user can see the surrounding image AP more clearly through the cabin image 200. Even when the illuminance of the surroundings of the vehicle 2 is low, the user easily understands the positional relationship of the vehicle 2 and the object located in the surroundings of the vehicle 2.

One of the transparency models 34*b* is selected by the user. The cabin image 200 of the selected transparency, model 34*b* is displayed on the display apparatus 4 at the transparency percentage of the selected transparency model 34*b*. Before one of the transparency models 34*b* is selected by the user (e.g. when being shipped from a factory), the transparency model 34*b* of the middle transparency percentage may be preset for the image processing apparatus 3. Thus, the surrounding image AP can be displayed through the cabin image 200 immediately after the image processing apparatus 3 is first activated.

The setting data 34*c* is data of the transparency percentage set by the user for each portion of the cabin image 200.

The program 34*d* is firmware that is read out and is executed by the controller 33 to control the image processing apparatus 3.

The signal receiver 35 obtains data relating to the vehicle 2 and sends it to the controller 33. The signal receiver 35 is connected to a shift sensor 35*a*, a steering wheel sensor 35*b*, a turn-signal switch 35*c*, a vehicle speed sensor 35*d* and a surrounding monitoring sensor 35*e*, via a LAN in the vehicle 2.

The shift sensor 35*a* detects a position of a shift lever, such as "DRive" and "Reverse." The shift sensor 35*a* sends shift data representing a current position of the shift lever to the signal receiver 35.

The steering wheel sensor 35*b* detects an angle and a direction, either to the right or left, by/in which the user has rotated the steering wheel from a neutral position (a position of the steering wheel to drive the vehicle 2 straightforward). The steering wheel sensor 35*b* sends angle data of the detected angle to the signal receiver 35. In other words, the steering wheel sensor 35*b* is a rotated direction obtaining part that obtains a rotated direction of the steering wheel.

The turn-signal switch 35*c* detects the right or the left that a turn-signal operated by the user indicates. The turn-signal switch 35*c* sends direction data of the detected direction to the signal receiver 35. In other words, the turn-signal switch 35*c* is an operation obtaining part that obtains an operation status of the turn-signal of the vehicle 2.

The vehicle speed sensor 35*d* is a speed obtaining part that obtains a speed of the vehicle 2. The vehicle speed sensor 35*d* sends speed data of the obtained speed to the signal receiver 35.

The surrounding monitoring sensor 35*e* detects an object located in the surroundings of the vehicle 2 and sends object data showing a direction and a distance of the object from the vehicle 2, to the signal receiver 35. Examples of the surrounding monitoring sensor 35*e* are clearance sonar using a sound wave, radar using a radio wave or an infrared lay, and a combination of those devices.

Next, an operation of each part included in the controller 33 is explained. The controller 33 includes a viewpoint changer 33*a*, a transparency percentage setting part 33*b* and an image outputting part 33*c*.

The viewpoint changer 33*a* sets the viewing position and the view direction of the virtual viewpoint. The details are described later.

The transparency percentage setting part 33*b* sets the transparency percentage of the cabin image 200 in a range from 0% to 100%. Based on the transparency percentage set by the transparency percentage setting part 33*b*, the image transparency adjustor 32*c*, described earlier, determines the transparency percentages for the plural portions of the cabin image 200 and causes the portions to be transparent at the determined individual transparency percentages. In addition to the preset transparency percentages, an arbitrary transparency percentage is set by the user.

The image outputting part 33*c* outputs the combined image generated by the image processor 32 to the display apparatus 4. Thus, the combined image is displayed on the display apparatus 4.

<1-3. Image Generation>

Figure 7:
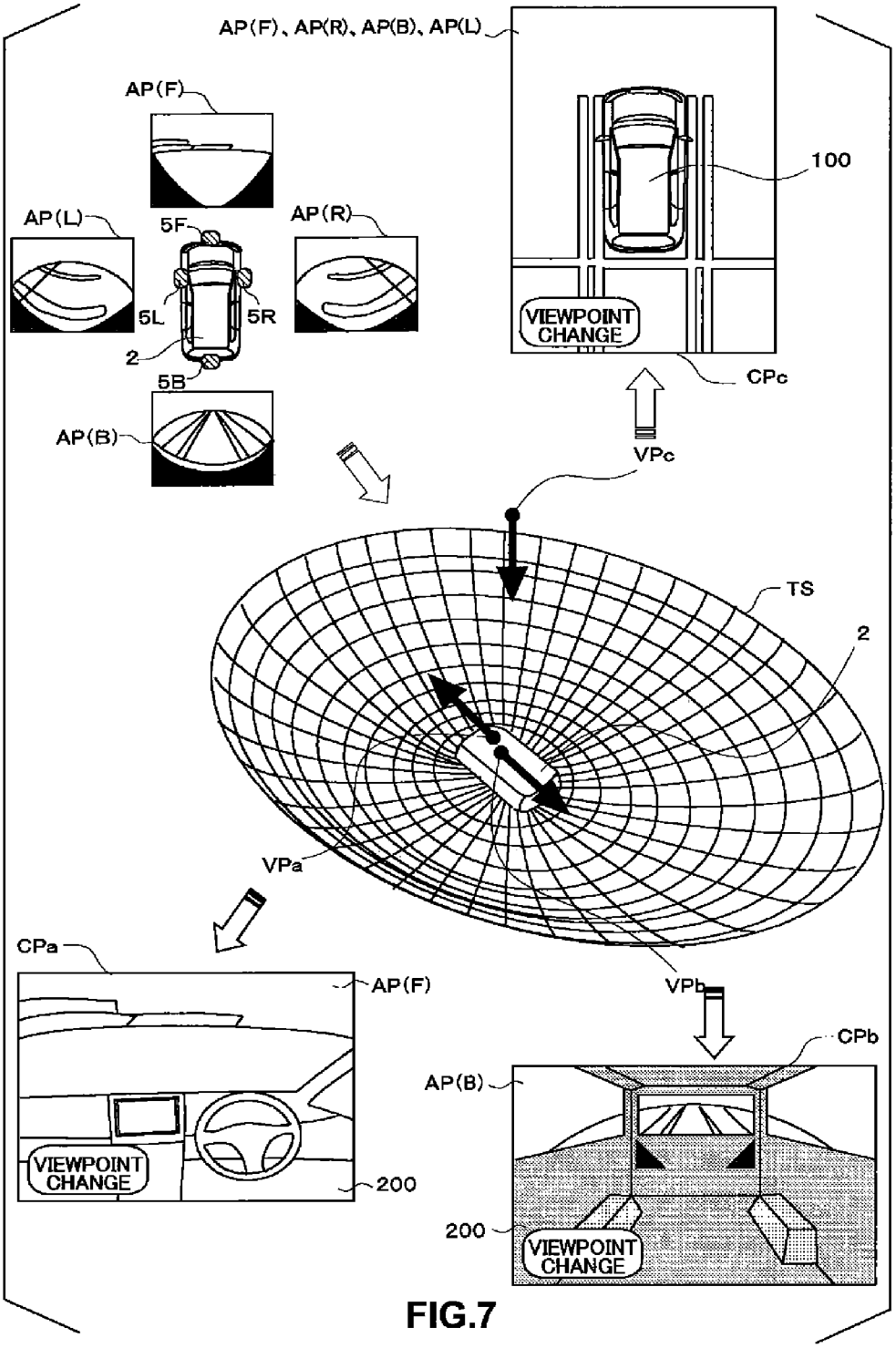
FIG. 7 illustrates a generation method of a combined image.

Next described is a method used by the image processor 32 to generate the surrounding image AP showing the surroundings of the vehicle 2 and the combined image CP by superimposing the cabin image 200 on the surrounding image AP. FIG. 7 illustrates a method used by the surrounding image generator 32*a* to generate the surrounding image AP.

Once the front camera 5F, the rear camera 5B, the left side camera 5L and the right side camera 5R capture images of the surroundings of the vehicle 2, images AP (F), AP (B), AP (L) and AP (R) that show areas in front, behind, left and right of the vehicle 2, respectively, are obtained. The four captured images include data showing 360-degree surroundings of the vehicle 2.

The surrounding image generator 32*a* projects the data (value of each pixel) included in these four images of AP (F), AP (B), AP (L) and AP (R) onto a projection surface TS that is a three-dimensional (3D) curved surface in virtual 3D space. The projection surface TS is, for example, substantially hemispherical (bowl-shaped). The vehicle 2 is defined to be located in a center region of the projection surface TS (a bottom of the bowl). Each region of the projection surface TS other than the center region corresponds to one of the AP (F), AP (B), AP (L) and AP (R).

First, the surrounding image generator 32*a* projects the surrounding images AP (F), AP (B), AP (L) and AP (R) onto the regions other than the center region of the projection surface TS. The surrounding image generator 32*a* projects the image AP (F) captured by the front camera 5F onto a region of the projection surface TS corresponding to an area in front of the vehicle 2 and the image AP (B) captured by the rear camera 5B onto a region of the projection surface TS corresponding to an area behind the vehicle 2. Moreover, the surrounding image generator 32*a* projects the image AP (L) captured by the left camera 5L onto a region of the projection surface TS corresponding to an area left of the vehicle 2 and the image AP (R) captured by the right camera 5R onto a region of the projection surface TS corresponding to an area right of the vehicle 2.

Next, the surrounding image generator 32*a* sets a virtual viewpoint VP in the virtual 3D space. The surrounding image generator 32*a* is configured to set the virtual viewpoint VP at an arbitrary viewing position in an arbitrary view direction in the virtual 3D space. Then, the surrounding image generator 32*a* clips from the projection surface TS, regions viewed from the set virtual viewpoint VP within a view angle, as images, and then combines the clipped images. Thus, the surrounding image generator 32*a* generates the surrounding image AP showing the surroundings of the vehicle 2 viewed from the virtual viewpoint VP.

Next, the combined image generator 32*b* generates the combined image CP by combining the surrounding image AP generated by the surrounding image generator 32*a*, the cabin image 200 read out from the memory 34, depending on the virtual viewpoint VP, and an icon image PI used for the touch panel 4*a*.

Figure 8:
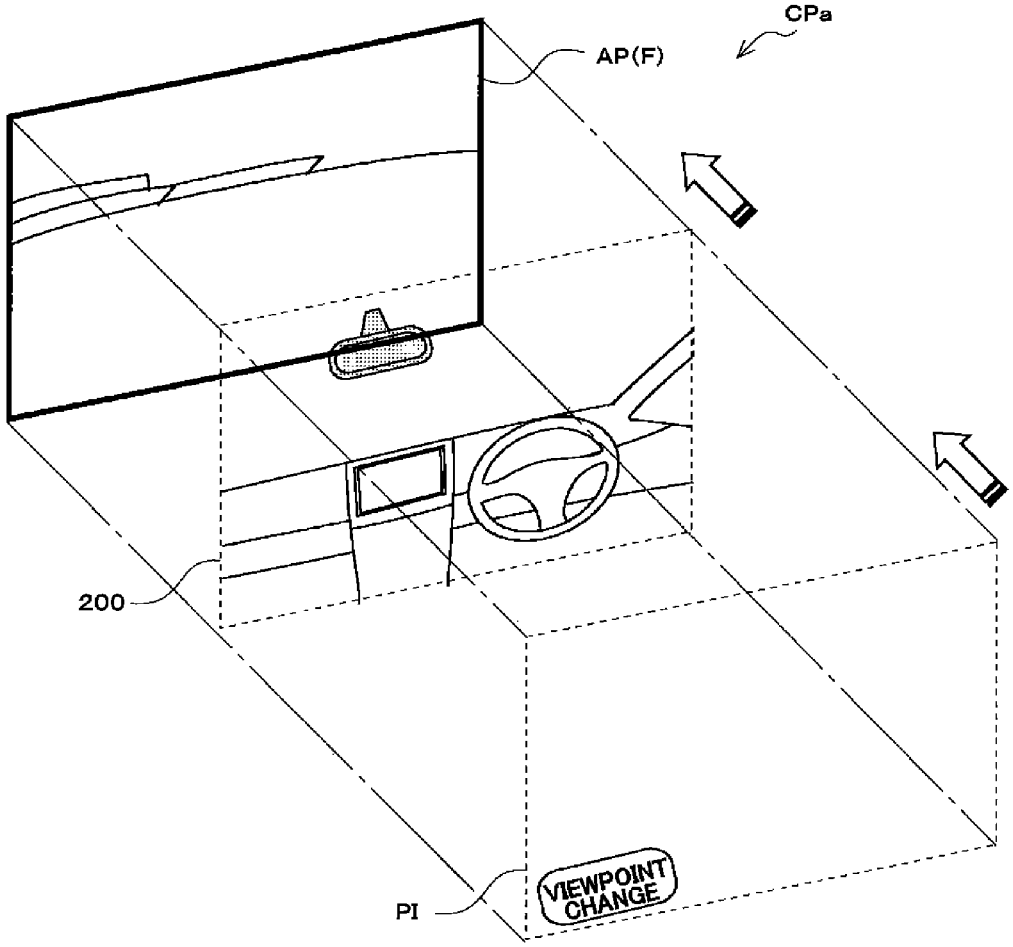
FIG. 8 illustrates a generation method of a combined image.

For example, in a case of a virtual viewpoint VPa of which the viewing position is located at the driver seat of the vehicle 2 in the view direction looking ahead of the vehicle 2, the combined image generator 32*b* generates a combined image CPa showing the cabin and the area in front of the vehicle 2, overlooking the area in front of the vehicle 2 from the driver seat. In other words, as shown in FIG. 8, when generating the combined image CPa of which the viewing position is located at the driver seat in the view direction looking ahead of the vehicle 2, the combined image generator 32*b* combines and superimposes the cabin image 200 showing the driver seat and the icon image PI on the surrounding image AP (F) showing the area in front of the vehicle 2.

In a case of a virtual viewpoint VPb of which the viewing position is located at the driver seat of the vehicle 2 in the view direction looking rearward of the vehicle 2, the combined image generator 32*b* generates a combined image CPb showing a back area of the cabin of the vehicle 2 and the surrounding area behind the vehicle 2, using the cabin image 200 showing a rear gate, etc. and the surrounding image AP (B).

In a case of a virtual viewpoint VPc of which a viewing position is located directly above the vehicle 2 in a view direction looking down (virtual viewpoint two-dimensionally looking downward), the combined image generator 32*b* generates a combined image CPc looking down the vehicle 2 and the surrounding area of the vehicle 2, using the vehicle body image 100 and the surrounding images AP (F), AP (B), AP (L) and AP (R).

<1-4. Procedure>

Figure 9:
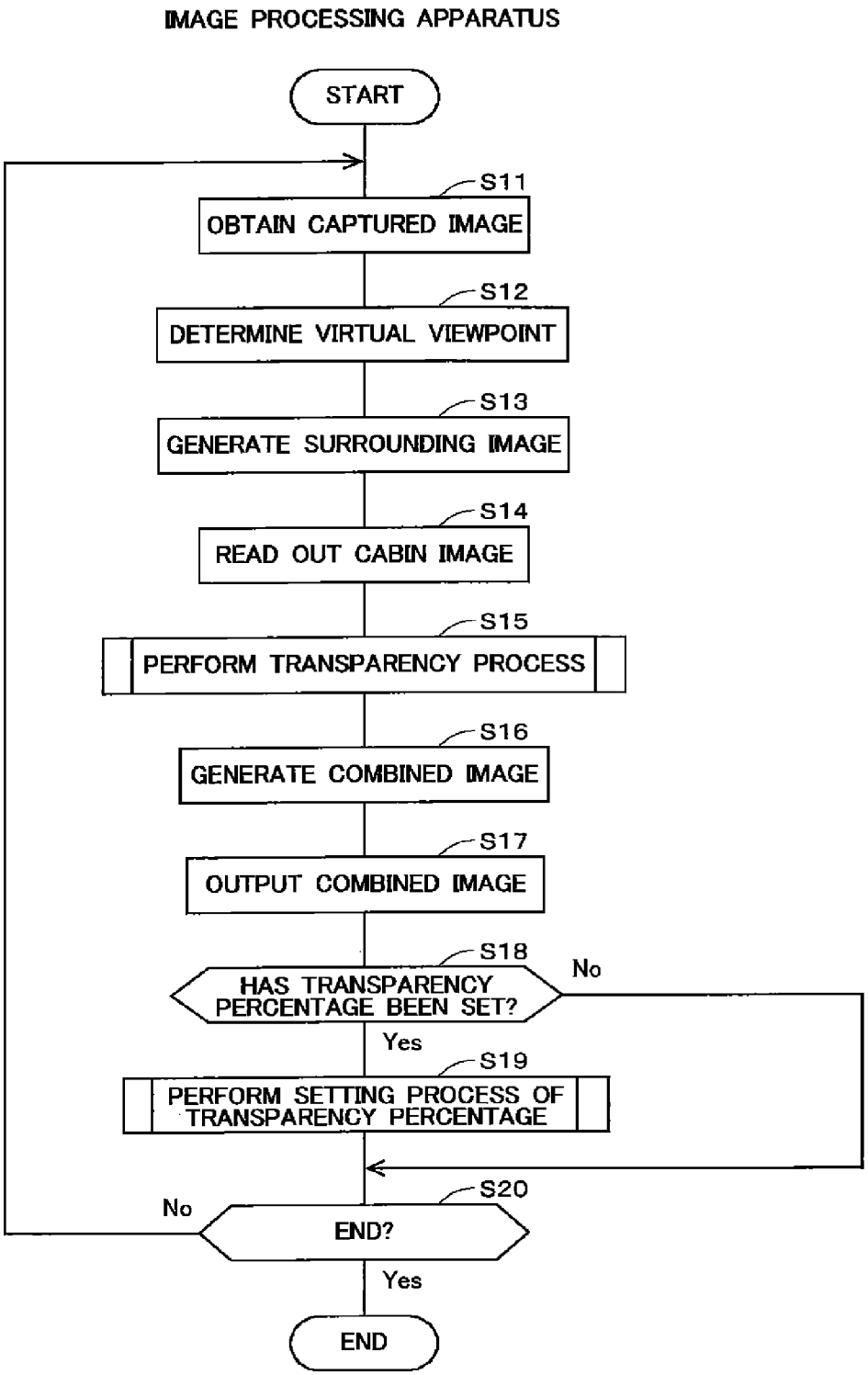
FIG. 9 illustrates a procedure performed by the image processing apparatus.

Next explained is a procedure performed by the image processing apparatus 3 to generate the combined image CP. FIG. 9 shows the procedure performed by the image processing apparatus 3. The procedure shown in FIG. 9 is repeated at a predetermine time interval (e.g. 1/30 second).

First, each of the plural cameras 5 captures an image. The image obtaining part 31 obtains the four captured images from the plural cameras 5 (a step S11). The image obtaining part 31 sends the obtained captured images to the image processor 32.

Once the image obtaining part 31 sends the captured images to the image processor 32, the viewpoint changer 33*a* of the controller 33 determines the viewing position and the view direction of the virtual viewpoint VP (a step S12). It is recommended that the viewpoint changer 33*a* should set the viewing position at the driver seat in the view direction looking ahead of the vehicle 2, as an initial setting for a displayed image, because the viewing position and the view direction are most comfortable for the user in the driver seat.

However, when the steering wheel or the turn-signal has been operated, the viewpoint changer 33*a* changes the view direction to a direction to which the steering wheel or the turn-signal has been operated because the operated direction is a traveling direction of the vehicle. In this case, the viewpoint changer 33*a* sets the view direction based on the angle data sent by the steering wheel sensor 35*b*, the direction data sent by the turn-signal switch 35*c*, etc.

Moreover, when the view direction looking ahead of the vehicle 2 is selected, the view direction looking a left front area of the vehicle 2 may be set. The left front of the vehicle 2 is often a blind area of the user in a case of the vehicle 2 having the steering wheel on a right side. Similarly, in a case of the vehicle 2 having the steering wheel on a left side, the view direction looking a right front area of the vehicle 2 may be set.

Moreover, when the position of the shift lever is changed to the "Reverse," the viewpoint changer 33*a* sets the view direction looking rearward of the vehicle 2 because the user intends to drive the vehicle 2 backwards. The viewpoint changer 33*a* determines the position of the shift lever based on the shift data sent from the shift sensor 35*a*.

Moreover, the viewing position and the view direction may be changed by an operation made by the user with the touch panel 4*a*. In this case, whenever the icon image PI displayed on the display apparatus 4 is operated, the virtual viewpoint VP is changed. In other words, images viewed from the three different virtual viewpoints VP are displayed in rotation. The three virtual viewpoints VP are: the virtual viewpoint VP having the viewing position located at the driver seat in the view direction looking ahead; the virtual viewpoint VP having the viewing position located at the driver seat in the view direction looking rearward; and the virtual viewpoint VP having the viewing position located at the overhead position in the view direction looking down straightly. Moreover, the image having the viewing position located at the driver seat and the image having the viewing position located at the overhead position may be simultaneously displayed side by side. In this case, the user can understand situations of the surroundings of the vehicle 2 viewed from plural positions, simultaneously. Therefore, the user can drive the vehicle 2 more safely.

Once the viewing position and the view direction of the virtual viewpoint VP are determined, the surrounding image generator 32*a* generates the surrounding image AP of the vehicle 2, using the method described above, based on the captured images captured by the image obtaining part 31 (a step S13).

Once the surrounding image AP is generated, the combined image generator 32*b* reads out the vehicle body image 100 or the cabin image 200, depending on the virtual viewpoint VP, from the memory 34 via the controller 33 (a step S14). In a case of the virtual viewpoint VP having the viewing position at the overhead position, the vehicle body image 100 is read out. In a case of the virtual viewpoint VP having the viewing position at the driver seat, the cabin image 200 is read out. A process of reading out the cabin image from the memory 34 performed by the combined image generator 32*b* is performed via the controller 33.

Next, the image transparency adjustor 32*c* performs a transparency process that changes the transparency percentage of the cabin image 200 read out in the method described above (a step S15). The transparency process will be described later.

Once the transparency percentage setting part 33*b* changes the transparency percentage of the cabin image 200, the combined image generator 32*b* generates the combined image CP based on the four captured images and the cabin image 200, in the method described above (a step S16).

Once the combined image generator 32*b* generates the combined image CP, the image outputting part 33*c* outputs the combined image CP to the display apparatus 4 (a step S17). The output combined image CP is displayed on the display apparatus 4 and the user can see the combined image CP.

Once the combined image CP is output, the transparency percentage setting part 33*b* of the controller 33 determines whether or not an instruction for setting the transparency percentage of the cabin image 200 has been given by the user via the touch panel 4*a* (a step S18).

Once determining that the instruction for setting the transparency percentage has been given (Yes in the step S18), the transparency percentage setting part 33*b* causes a screen used for setting the transparency percentage to be displayed on the display apparatus 4 and performs a setting process of the transparency percentage (a step S19). The setting process will be described later.

Once the setting process of the transparency percentage is performed or once the transparency percentage setting part 33*b* determines that the instruction for setting the transparency percentage has not been given (No in the step S18), the controller 33 determines whether or not an instruction for ending the display of the combined image CP has been given by the user (a step S20). The controller 33 determines whether or not the instruction has been given, based on presence or absence of an operation made by the user with a button (not illustrated) for ending the display of the image because there is a case where the user wants to end the display of the combined image CP for display of a navigation screen and the like.

Once determining that the instruction for ending the display of the combined image CP has been given (Yes in the step S20), the image outputting part 33*c* stops output of the combined image CP. Once the image outputting part 33*c* stops the output of the combined image CP, this process ends.

On the other hand, once the image outputting part 33*c* determines that the instruction for ending the display of the combined image CP has not been given (No in the step S20), the process returns to the step S11. Once the process returns to the step S11, the image obtaining part 31 obtains four captured images from the four cameras 5 again. Then, the process after the step S11 is repeated. In a case where, the user sets a different display mode in the step S19 or in a case where the user sets an arbitrary transparency percentage, the combined image CP is generated in the set display mode and/or at the set transparency percentage in the repeated process.

Figure 10:
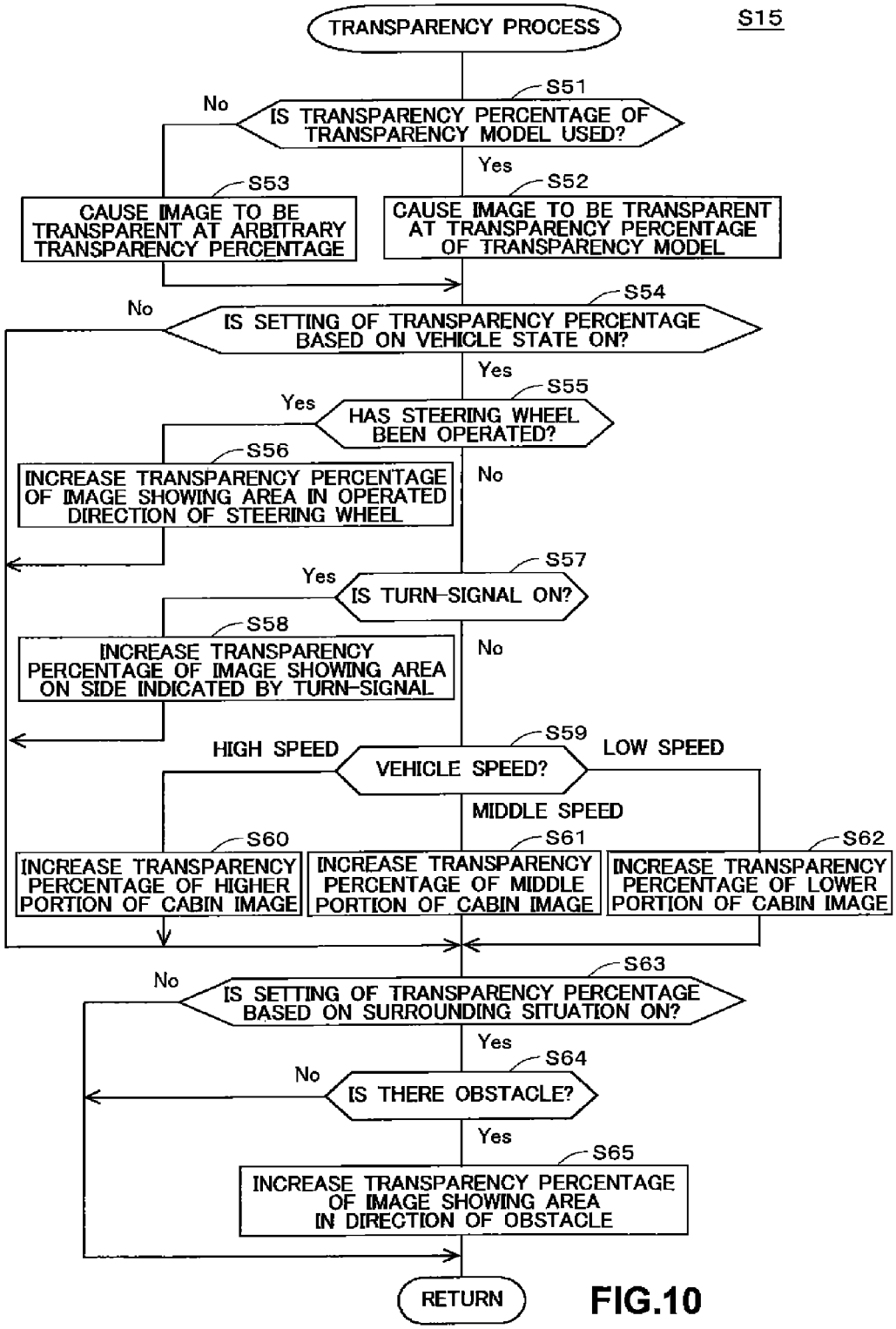
FIG. 10 illustrates a procedure for a transparency process.

Next, the transparency process of the cabin image 200 performed in the step S15 is explained with reference to the drawing from FIG. 10 to FIG. 16. FIG. 10 shows a procedure of the transparency process. FIG. 10 shows details of the step S15. Once the step S15 is performed, the controller 33 determines whether to cause the cabin image 200 to be transparent at the transparency percentage of the transparency model 34*b* or at an arbitrary transparency percentage set by the user (a step S51). The controller 33 determines one of the transparency percentages based on the setting data 34*c* stored in the memory 34.

In a case where the controller 33 determines to cause the cabin image 200 to be transparent at the transparency percentage of the transparency model 34*b* (Yes in the step S51), the image transparency adjustor 32*c* causes the cabin image 200 to be transparent at the transparency percentage of the transparency model 34*b* selected beforehand by the user. The transparency process for the cabin image 200 is performed in the method described above (a step S52).

On the other hand, in the case where the controller 33 determines to cause the cabin image 200 to be transparent at the arbitrary transparency percentage set by the user (No in the step S51), the image transparency adjustor 32*c* causes the cabin image 200 to be transparent at the arbitrary transparency percentage set by the user (a step S53).

Next, the controller 33 determines whether or not a "setting of transparency percentage based on a vehicle state," which is one display mode (a step S54). A vehicle state means a state of an apparatus included in a vehicle, such as an operation status of the steering wheel, and a state of the vehicle itself, such as a vehicle speed. In a case where the display mode of the "setting of transparency percentage based on a vehicle state" is on, the image transparency adjustor 32*c* determines the transparency percentage of the cabin image 200 based on the vehicle state.

When determining that the display mode of the "setting of transparency percentage based on a vehicle state" is on (Yes in the step S54), the controller 33 determines, based on a sensor signal sent from the steering wheel sensor 35*b*; whether or not the steering wheel has been operated by the user (a step S55).

When determining that the steering wheel has been operated (Yes in the step S55), the image transparency adjustor 32*c* changes the transparency percentage of a portion of the cabin image 200 showing an area in a direction in which the steering wheel has been operated (a step S56). The direction to which the steering wheel is operated refers to a direction to which the steering wheel is rotated. The viewpoint changer 33*a* sets the view direction of the virtual viewpoint in the direction in which the steering wheel has been operated. Moreover, the transparency percentage is changed. For example, the transparency percentage is increased by 50% as compared to the transparency percentage before the change. However, in a case of a low transparency percentage of less than 50% before the change, the image transparency adjustor 32*c* may set the transparency percentage approximately at 80% or 100%.

Figure 11:
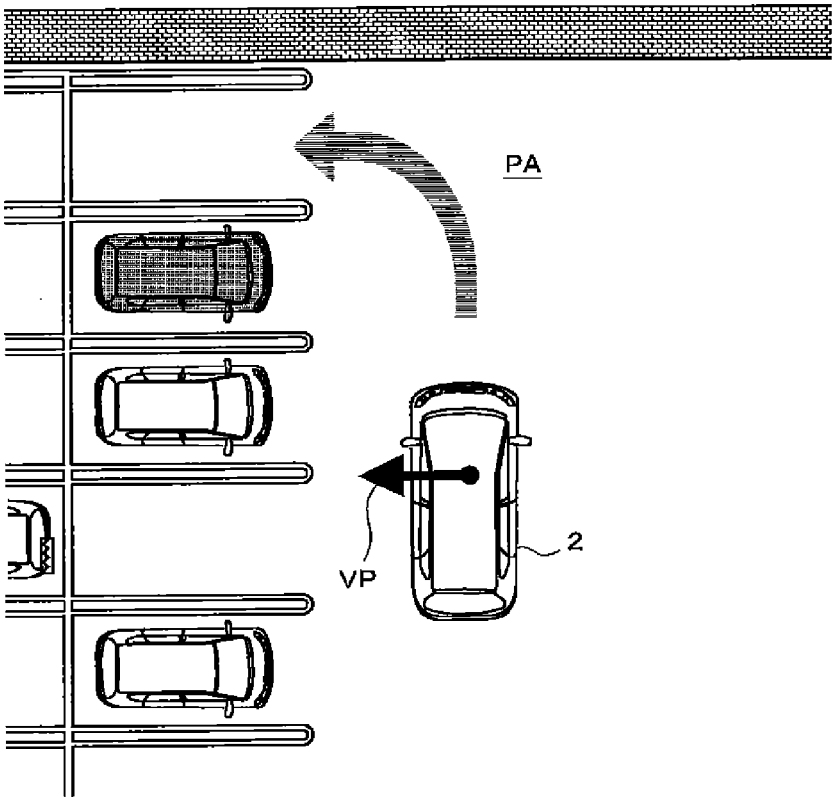
FIG. 11 shows an example of the transparency process.

FIG. 11 shows a situation where the vehicle 2 of which the steering wheel is operated in a left direction at a parking lot PA. Since the steering wheel is operated in the left direction, the viewpoint changer 33*a* sets the view direction of the virtual viewpoint VP in the left direction of the vehicle 2.

Figure 12:
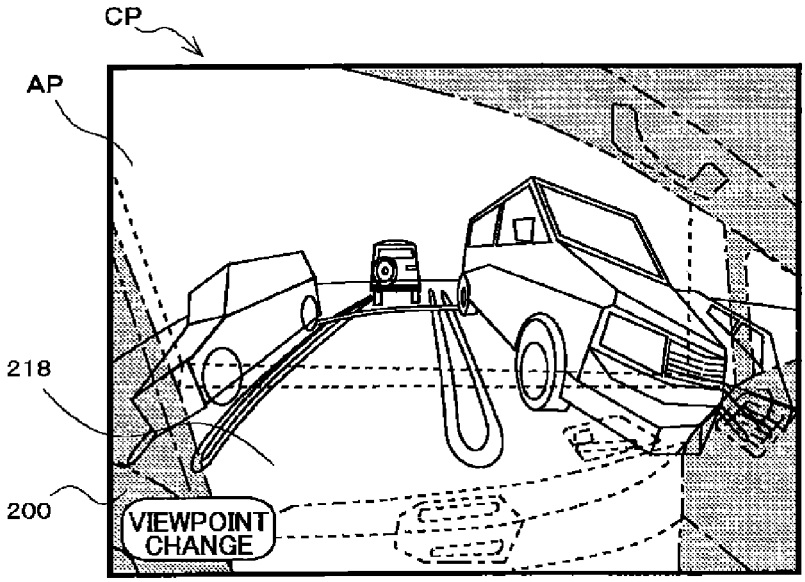
FIG. 12 shows an example of the transparency process.

FIG. 12 shows the combined image CP displayed on the display apparatus 4 in the situation shown in FIG. 11. The displayed combined image CP shows the cabin image 200 superimposed on the surrounding image AP showing the parking lot PA. Moreover, the cabin image 200 is displayed at the transparency percentage of 50% and other parked vehicles are displayed through the cabin image 200. Moreover, since the steering wheel is operated to the left direction, the transparency percentage of the left door panel 218 located in the direction in which the steering wheel has been operated is increased to 100% by the image transparency adjustor 32*c*.

As mentioned above, since a traveling direction of the vehicle 2 is equivalent to the direction in which the steering wheel has been operated, by increasing the transparency percentage of the portion of the cabin image 200 in the direction, presence or absence of an obstacle in the traveling direction can be clearly shown to the user. Thus, when parking the vehicle 2, the user can intuitively understand a positional relationship between the vehicle 2 and another vehicle or equipment in the parking lot, and can avoid a contact to the obstacle, etc., easily.

Further, for example, when the transparency percentage of the left door panel is increased at a time of turning to the left at a traffic intersection, the user can more easily recognize a pedestrian, a motorcycle, etc. moving near the vehicle 2. Thus, it is helpful to prevent an accident involving the pedestrian, the motorcycle, etc. Further, when the transparency percentage of a portion of the cabin image 200 is increased as compared to other portions, more attention of the user can be drawn to the portion of which the transparency percentage is increased.

FIG. 10 is again referred. When the transparency percentage of the portion of the cabin image 200 showing an area in the direction in which the steering wheel has been operated is increased in the step S56, or when the controller 33 determined that the display mode of the "setting of transparency percentage based on a vehicle state" is not on in the step S54, a step S63 is performed. The procedure of the step S63 and after is described later.

Next, when determining that the steering wheel has not been operated by the user (No in the step S55), the controller 33 determines, based on a control signal sent from the turn-signal switch 35*c*, whether or not the turn-signal is on (a step S57).

When determining that the turn-signal is on (Yes in the step S57), the image transparency adjustor 32*c* increases the transparency percentage of a portion of the cabin image 200 showing an area diagonally in front of the vehicle 2 on a side indicated by the turn-signal (a step S58). In other words, the image transparency adjustor 32*c* determines the transparency percentage of the cabin image 200 based on an operational status of the turn-signal. The image transparency adjustor 32*c* increases the transparency percentage of the portion of the cabin image 200 showing the area diagonally in front of the vehicle 2 on the side indicated by the turn-signal because the side indicated by the turn-signal is only a predicted traveling direction in which the vehicle 2 will travel and there is a case where the vehicle 2 has not moved or turned yet to the right or the left, being different from the case of the steering wheel. Therefore, when the turn-signal is on, it is recommended that the cabin image 200 having the portion showing the area diagonally in front of the vehicle 2 at an increased transparency percentage should be displayed, rather than a portion showing an area lateral to the vehicle 2 at an increased transparency percentage.

Next, the viewpoint changer 33*a* sets the view direction of the virtual viewpoint in the direction that the turn-signal indicates. However, the viewpoint changer 33*a* may set the view direction of the virtual viewpoint looking the area diagonally in front of or in front of the vehicle 2 on the side indicated by the turn-signal. In other words, as long as the surrounding image AP displayed on the display apparatus 4 includes the area diagonally in front of the vehicle 2 on the side indicated by the turn-signal, any direction may be set as the view direction. Moreover, a method of increasing the transparency percentage is a same as the method used in the step S56.

Figure 13:
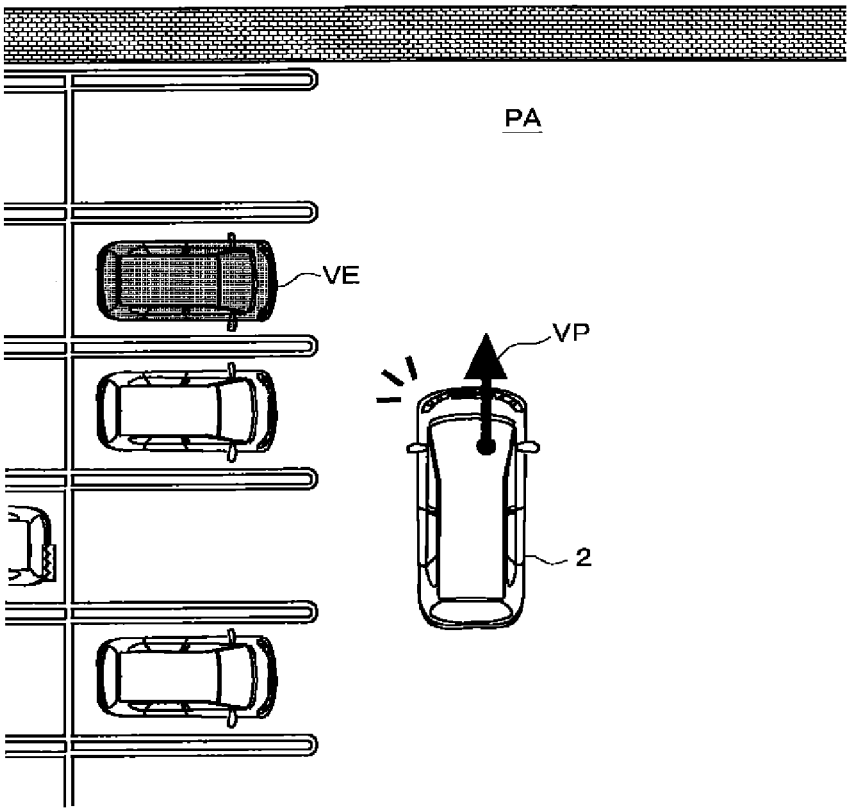
FIG. 13 shows an example of the transparency process.

FIG. 13 shows the vehicle 2 of which the turn-signal is indicating the left side in the parking lot PA. Since the turn-signal is indicating the left side, the viewpoint changer 33*a* sets the view direction of the virtual viewpoint VP looking the area in front of the vehicle 2 including the area diagonally in front of the vehicle 2. Moreover, the different parked vehicle VE is parked in front left of the vehicle 2.

Figure 14:
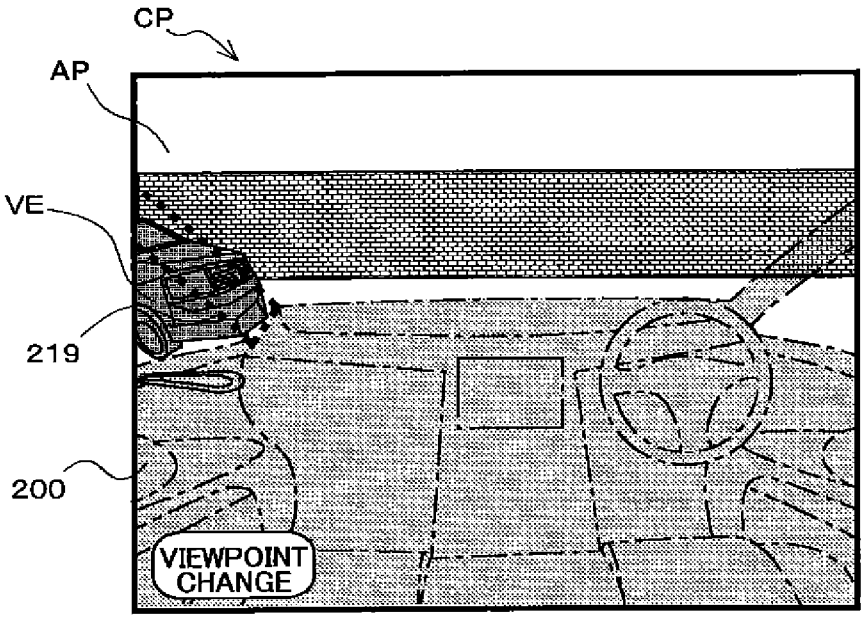
FIG. 14 shows an example of the transparency process.

FIG. 14 shows the combined image CP displayed on the display apparatus 4 in the situation shown in FIG. 13. The displayed combined image CP is an image where the cabin image 200 is superimposed on the surrounding image AP showing the parking lot PA. Moreover, the cabin image 200 is displayed at 50% of the transparency percentage. Thus, the parking lot PA is displayed through the cabin image 200. Further, since the turn-signal is indicating the left side, the transparency percentage of the left front pillar 219 in left front of the vehicle 2 is increased to 100% by the image transparency adjustor 32*c*. Thus, the user can visually estimate a position of the parked vehicle VE accurately, and can park the vehicle 2 smoothly without a contact to the parked vehicle VE.

As mentioned above, since the side indicated by the turn-signal is the traveling direction in which the vehicle 2 will travel, it is recommended that the transparency percentage of a portion of the cabin image 200 showing an area diagonally in front of the vehicle 2 should be increased. Moreover, more attention of the user can be drawn to the portion of the cabin image 200.

FIG. 10 is again referred. When determining that the turn-signal is not on (No in the step S57), the controller 33 determines, based on the speed data sent from the vehicle speed sensor 35*d*, whether a vehicle speed of the vehicle 2 is high speed, middle speed or low speed. For example, the high speed is 80 km/h or more, the middle speed is between less than 80 km/h and 30 km/h, and the low speed is less than 30 km/h. The low speed includes 0 km/h, i.e. a stopping state.

In a case where the controller 33 determines that the vehicle speed is the high speed ("high speed" in the step S59), the image transparency adjustor 32*c* increases the transparency percentage of a higher portion of the cabin image 200 (a step S60). Moreover, the viewpoint changer 33*a* sets the view direction of the virtual viewpoint VP looking ahead or rearward of the vehicle 2, depending on the position of the shift lever. When the position of the shift lever is in "Drive," the viewpoint changer 33*a* sets the view direction of the virtual viewpoint VP looking ahead of the vehicle 2. When the position of the shift lever is in "Reverse," the viewpoint changer 33*a* sets the view direction of the virtual viewpoint VP looking rearward of the vehicle 2. The viewpoint changer 33*a* sets the view direction of the virtual viewpoint VP and the method for setting the view direction is also used in a step S61 and in a step 62, described later.

The image transparency adjustor 32*c* increases the transparency percentage of the higher portion of the cabin image 200 because the user generally looks far ahead or rearward, not near ahead or rearward, during driving at the high speed. Therefore, by increasing the transparency percentage of the higher portion of the cabin image 200 that is a portion of the surrounding image AP showing an area far ahead in the line of the sight of the user, an area that the user needs to see during the driving at the high speed can be displayed. The higher portion of the cabin image 200 is, for example, a portion higher than, approximately, one-half a height of the vehicle 2. Moreover, the higher portion of the cabin image 200 should include an actual view of the user during the driving at the high speed.

In a case where the controller 33 determines that the vehicle speed is the middle speed ("middle speed" in the step S59), the image transparency adjustor 32*c* increases the transparency percentage of a middle portion of the cabin image 200 (the step S61). Moreover, the viewpoint changer 33*a* sets the view direction of the virtual viewpoint VP looking an area in front of the vehicle 2 because the user generally looks slightly lower than the area far ahead, during driving at the middle speed. Therefore, by increasing the transparency percentage of the middle portion of the cabin image 200 that is a portion of the surrounding image AP showing an area slightly lower than the area far ahead in the line of the sight of the user, an area that the user needs to see during the driving at the middle speed can be displayed. The middle portion of the cabin image 200 is, for example, a middle of the vehicle 2 when the height of the vehicle 2 is divided into three. Moreover, the middle portion of the cabin image 200 should include the actual view of the user during the driving at the middle speed.

In a case where the controller 33 determines that the vehicle speed is the low speed ("low speed" in the step S59), the image transparency adjustor 32*c* increases the transparency percentage of a lower portion of the cabin image 200 (the step S62). Moreover, the viewpoint changer 33*a* sets the view direction of the virtual viewpoint VP looking an area in front of the vehicle 2 because user may pass by an obstacle during driving at the low speed so that the user generally looks things near the vehicle more often. Therefore, by increasing the transparency percentage of the lower portion of the cabin image 200 that is a portion of the surrounding image AP showing an area close to the vehicle in the line of the user, an area that the user needs to see during the driving at the low speed can be displayed. The lower portion of the cabin image 200 is, for example, a portion lower than, approximately, one-half the height of the vehicle 2. Moreover, the lower area of the cabin image 200 should include the actual view of the user during the driving at the low speed.

As described above, as the vehicle speed becomes higher, the image transparency adjustor 32*c* increases the transparency percentage of an area corresponding to a higher area of the vehicle, of the cabin image 200. Moreover, as the vehicle speed becomes lower, the image transparency adjustor 32*c* increases the transparency percentage of an area corresponding to a lower area of the vehicle, of the cabin image 200.

Next, the controller 33 determines whether or not a display mode of the "setting of transparency percentage based on a surrounding situation" is on (the step S63). Here, the surrounding situation refers to a situation in the surroundings of the vehicle that may have any influence on the vehicle, for example, presence or absence of an obstacle located adjacent to the vehicle.

When determining that the display mode of the "setting of transparency percentage based on a surrounding situation" is on (Yes in the step S63), the controller 33 determines whether or not there is an obstacle adjacent to the vehicle 2 (a step S64) based on the object data sent from the surrounding monitoring sensor 35*e*.

When the controller 33 determines that there is an obstacle (Yes in the step S64), the image transparency adjustor 32*c* increases the transparency percentage of a portion of the cabin image 200 showing an area in a direction where the obstacle is located (a step S65). In other words, the image transparency adjustor 32*c* determines the transparency percentage of the cabin image 200 based on a position of the obstacle located adjacent to the vehicle 2. Then, the viewpoint changer 33*a* sets the view direction of the virtual viewpoint looking in the direction where the obstacle is located. However, as long as the surrounding image AP includes the direction where the obstacle is located, any direction may be set as the view direction. A method of increasing the transparency percentage is a same as the method used in the step S56.

Figure 15:
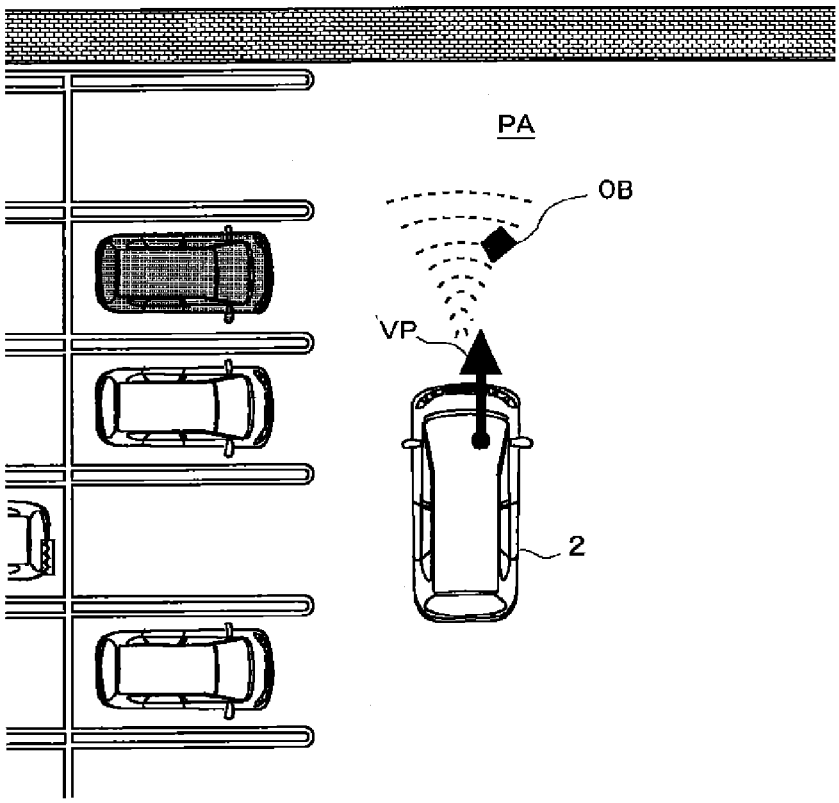
FIG. 15 shows an example of the transparency process.

FIG. 15 shows a situation where there is an obstacle OB located in front of the vehicle 2 in the parking lot PA. The obstacle OB is detected by the surrounding monitoring sensor 35*e* on the vehicle 2 and the view direction of the virtual viewpoint VP looking ahead of the vehicle 2 is set by the viewpoint changer 33*a*.

Figure 16:
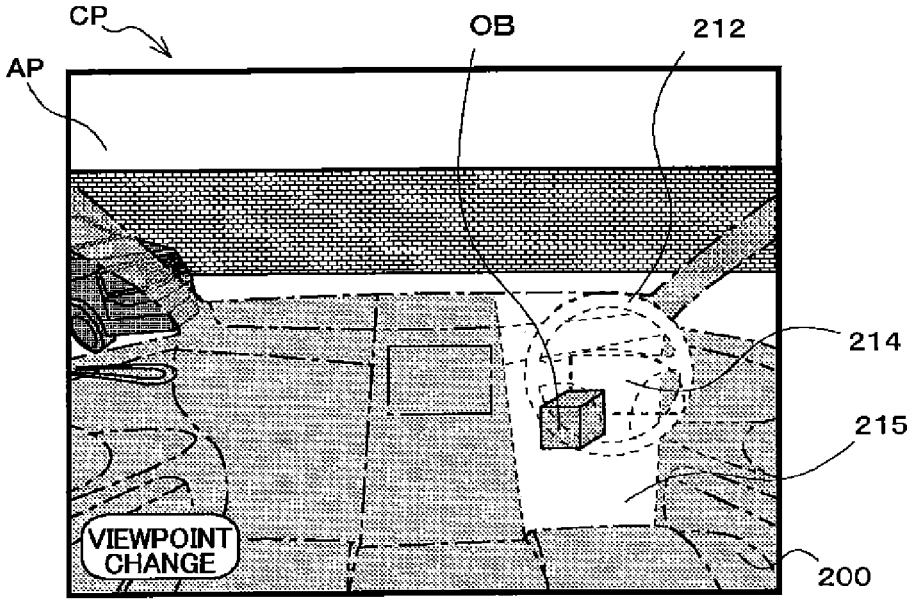
FIG. 16 shows an example of the transparency process.

FIG. 16 shows the combined image CP displayed on the display apparatus 4 in the situation shown in FIG. 15. The displayed combined image CP is an image where the cabin image 200 is superimposed on the surrounding image AP showing the parking lot PA. Moreover, the cabin image 200 is displayed at 50% of the transparency percentage. Thus, the parking lot PA is displayed through the cabin image 200. Further, since the obstacle OB located in front of the vehicle 2 is detected, the image transparency adjustor 32*c* increases the transparency percentages of the right dashboard 215, the steering wheel 212 and the right headlamp 214 to 100%. Thus, the user can visually estimate a position of the obstacle OB accurately, and can park the vehicle 2 smoothly without a contact to the obstacle OB. Further, more attention of the user can be draws to the obstacle OB through the cabin image 200 displayed at the increased transparency percentage.

Once the procedure of increasing the transparency percentage of the cabin image 200 is performed, the procedure returns to the step S16 shown in FIG. 9 and repeats the steps from the step S16. Moreover, when the controller 33 determines that the display mode of the "setting of transparency percentage based on a surrounding situation" is off (No in the step S63) or when the controller 33 determines that there is no obstacle adjacent to the vehicle 2 (No in the step S64), the procedure also returns to the step S16 shown in FIG. 9 and repeats the steps from the step S16.

As described above, in the transparency process of the cabin image 200, after causing the cabin image 200 to be transparent based on the transparency model 34*b* or the setting data 34*c* set by the user, the image transparency adjustor 32*c* increases the transparency percentage of a part, depending on the vehicle state or the surrounding situation. Thus, the user can intuitively understand the positional relationship of the vehicle 2 and an object located in the surroundings of the vehicle 2.

Figure 17:
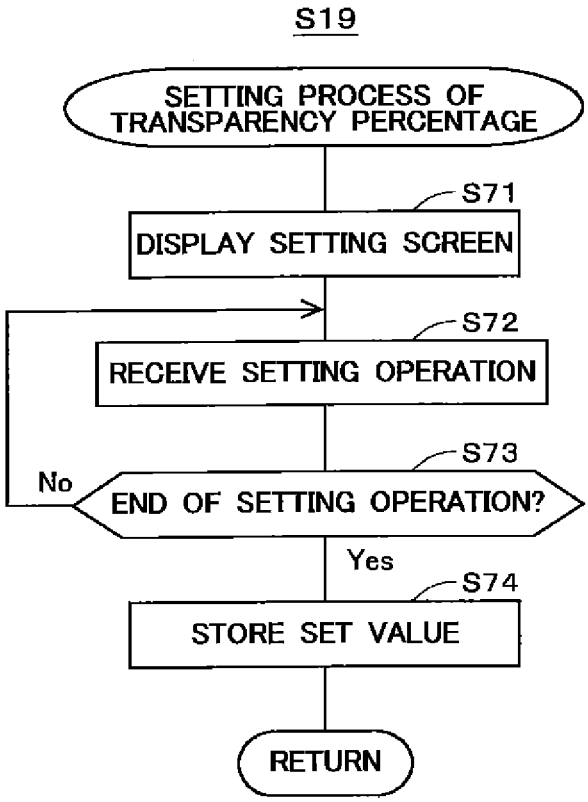
FIG. 17 illustrates a procedure for a setting process of a transparency percentage.

Next, the setting process of the transparency percentage in the step S19 is explained with reference to FIG. 17. FIG. 17 shows a procedure for the setting process of the transparency percentage and illustrates details of the step S19. Once the step S19 is performed, first, the image outputting part 33*c* causes a setting screen that is used to set the transparency percentage to be displayed on the display apparatus 4 (a step S71).

Next, the controller 33 receives an operation by the user with the touch panel 4*a* (a step S72).

The controller 33 determines whether or not the setting operation should be ended (a step S73) based on whether or not the user has touched a predetermined end button on the touch panel 4*a*.

When determining that the setting operation should be ended (Yes in the step S73), the controller 33 stores a set value input as the setting data 34*c* in the memory 34 (a step S74). The image transparency adjustor 32*c* determines the transparency percentage for each of plural portions of the cabin image 200, based on the setting data 34*c* set based on the operation made by the user (the step 53 in FIG. 10). Thus, it is possible to cause portions of the cabin image 200 to be transparent at individual transparency percentages such that the user sees the cabin image 200 more easily.

Once the set value is stored in the memory 34, the process returns the procedure shown in FIG. 9.

On the other hand, when determining that the setting operation should not be ended (No in the step S73), the controller 33 performs the step S72 again and receives the operation made by the user with the touch panel 4*a*. Then, until the end button for the setting operation is touched, the controller 33 repeats the procedure of receiving the operation.

Figure 18:
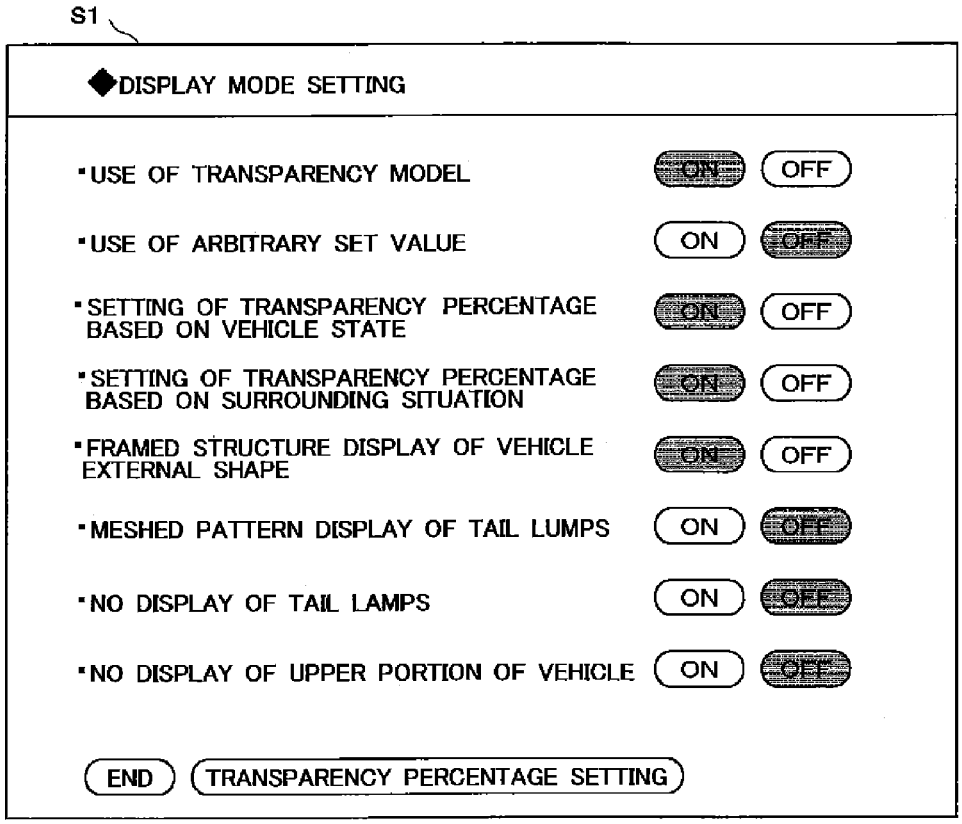
FIG. 18 shows a setting screen for a display mode.
Figure 19:
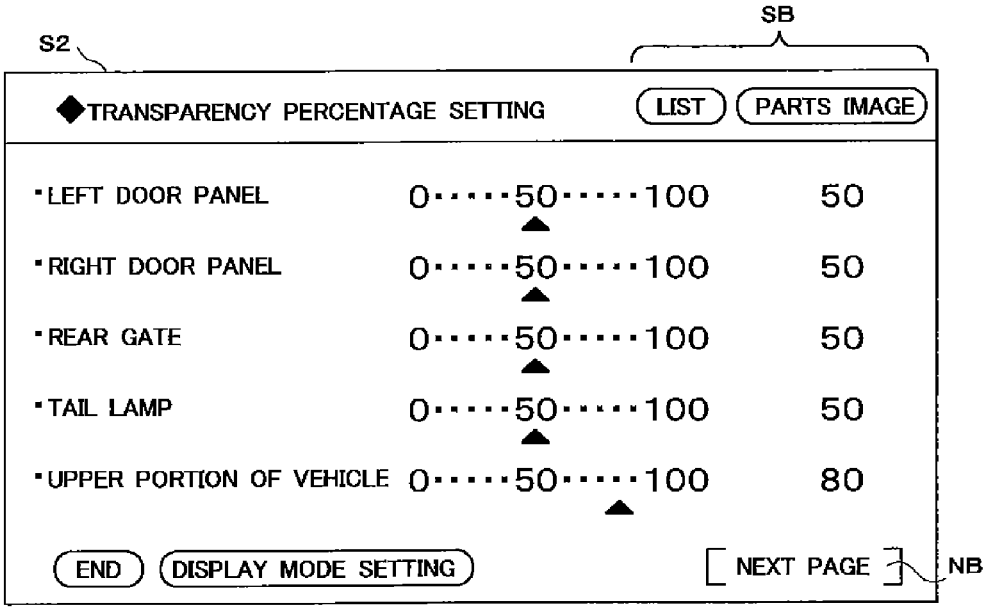
FIG. 19 shows a setting screen for a transparency percentage.
Figure 20:
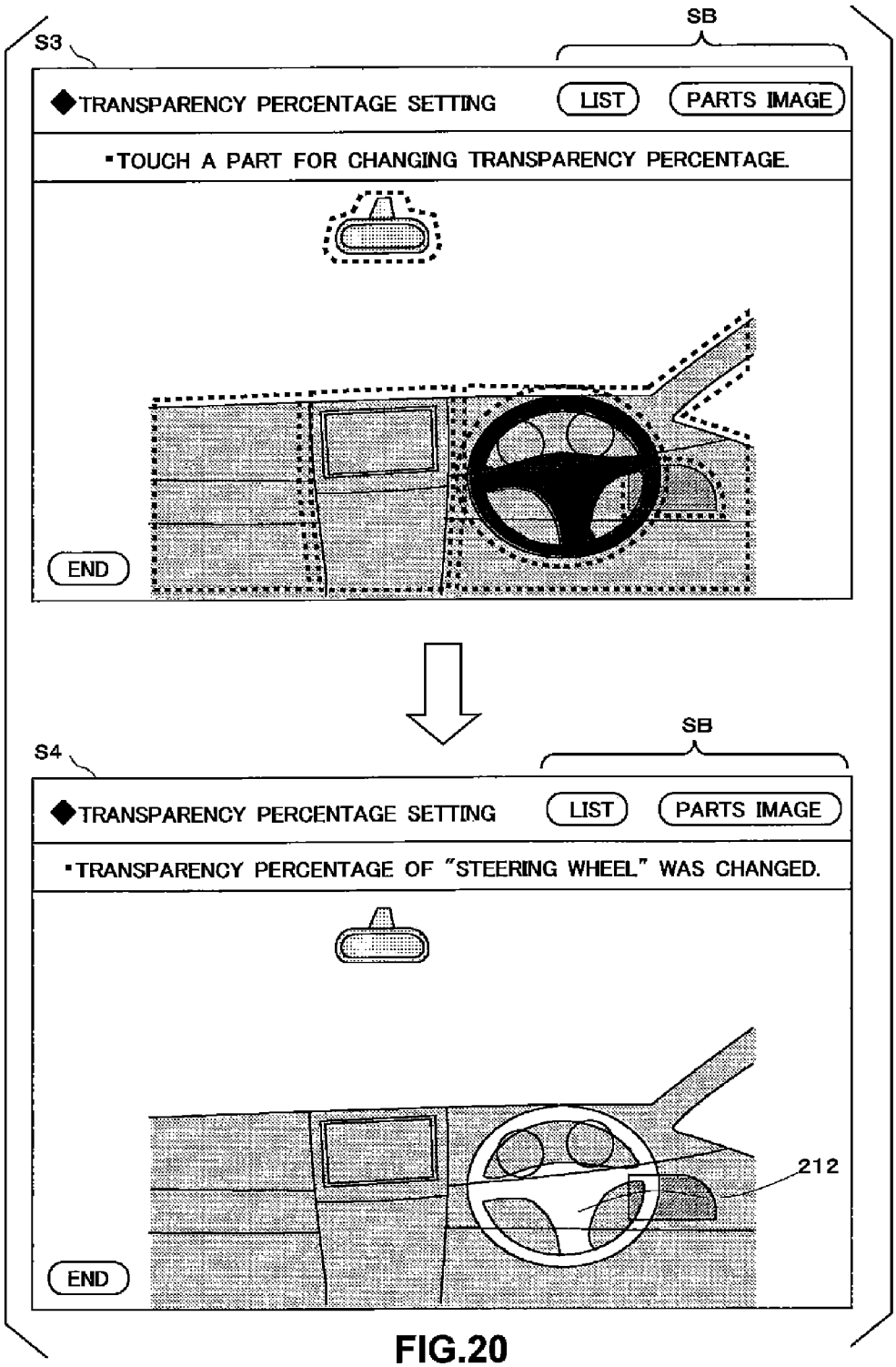
FIG. 20 shows a setting screen for a transparency percentage.

Next, with reference to the drawings from FIG. 18 to FIG. 20, the setting screen displayed in the step S71 in FIG. 17 is explained. Two setting screens are provided, one of which is a display mode setting screen and the other is a transparency percentage setting screen that is used to set the transparency percentage for each of the parts of the cabin image 200.

FIG. 18 shows an example of a display mode setting screen S1. By using the display mode setting screen S1, the user can select use or non-use of the transparency model 34*b* or of a set value arbitrarily set by the user. When user selects one of the transparency models 34*b* and the arbitrarily set value, the other becomes automatically unselectable because two transparency percentages cannot be used simultaneously. Among other user-settable items are: the setting of the transparency percentage based on a vehicle state; the setting of the transparency percentage based on a surrounding situation; framed structure display of the vehicle external shape; mesh pattern display of tail lamps; no display of tail lamps and no display of an upper portion of the vehicle. These items are selectable on the display mode setting screen S1.

FIG. 19 shows an example of a transparency percentage setting screen S2 for each part. By using the transparency percentage setting screen S2, the user can set the transparency percentage for each part at which the image transparency adjustor 32*c* causes the part to be transparent when "use of the arbitrarily set value" is ON.

A list of parts of which the transparency percentages are settable is displayed on the transparency percentage setting screen S2. The user enters an arbitrary transparency percentage for each part. Examples of the parts of which the transparency percentages are settable are the left door panel, a right door panel, the rear gate, the tail lamps and the upper portion of the vehicle.

Due to limitations of space of the display apparatus 4, if it is not possible to display all the parts on one page, a button NB for moving to a next page may be provided and the parts may also be displayed on the next page. For example, the steering wheel, the dashboard, the tires, the wheel housings, the headlamps, the rearview mirror are listed on the next page. The transparency percentages of those parts are settable in a range from 0% to 100% on the transparency percentage setting screen S2.

The transparency percentage setting screen S2 shows the list of the parts. However, the parts may be displayed on the cabin image 200 and the user may touch and select one of the parts on the cabin image 200 to set the transparency percentage for the part. FIG. 20 shows an example of a transparency percentage setting screen S3 via parts displayed on an image. In other words, FIG. 20 is an example that shows the portions of which the transparency percentages can be settable is output and displayed on the display apparatus 4, of the plural portions of the cabin image 200.

The transparency percentage setting screen S3 via parts displayed on an image, shown in an upper drawing in FIG. 20, is the cabin image 200 including the parts on which frame borders are superimposed individually. The user touches an area inside the frame border of the part for which the transparency percentage the user desires to set. Thus, the user can select more easily the part to set the transparency percentage thereof, as compared to the list of the parts.

Then, based on the operation made by the user with the part displayed on the display apparatus 4, for which the transparency percentage is set, the image transparency adjustor 32*c* identifies the part and changes the transparency percentage thereof. Since the cabin image 200 including the part at the changed transparency percentage is superimposed on the surrounding image AP and is displayed, the user can immediately see a combined image displayed at the changed transparency percentage. Thus, the user can set the transparency percentage comfortable to a sense of each user. For example, as shown in a lower drawing in FIG. 20, in a case where the user has selected the steering wheel 212 and has increased the transparency percentage of the steering wheel 212, the user can immediately see the steering wheel 212 at the changed transparency percentage and other parts.

As shown in FIG. 19 and FIG. 20, it is recommended that a selection button SB should be provided on the touch panel 4*a* for the user to change the setting screen to the transparency percentage setting screen S2 via the list of parts or to the transparency percentage setting screen S3 via parts displayed on an image because the setting screen that is more comfortable to use depends on users and use situations.

Next explained, with reference to the drawings from FIG. 21 to FIG. 24, are examples where display of the parts is changed via the display mode setting screen S1. The display modes that can be set via the display mode setting screen S1 are the framed structure display of the vehicle external shape, the mesh pattern display of tail lamps, the no display of tail lamps and the no display of an upper portion of the vehicle.

Figure 21:
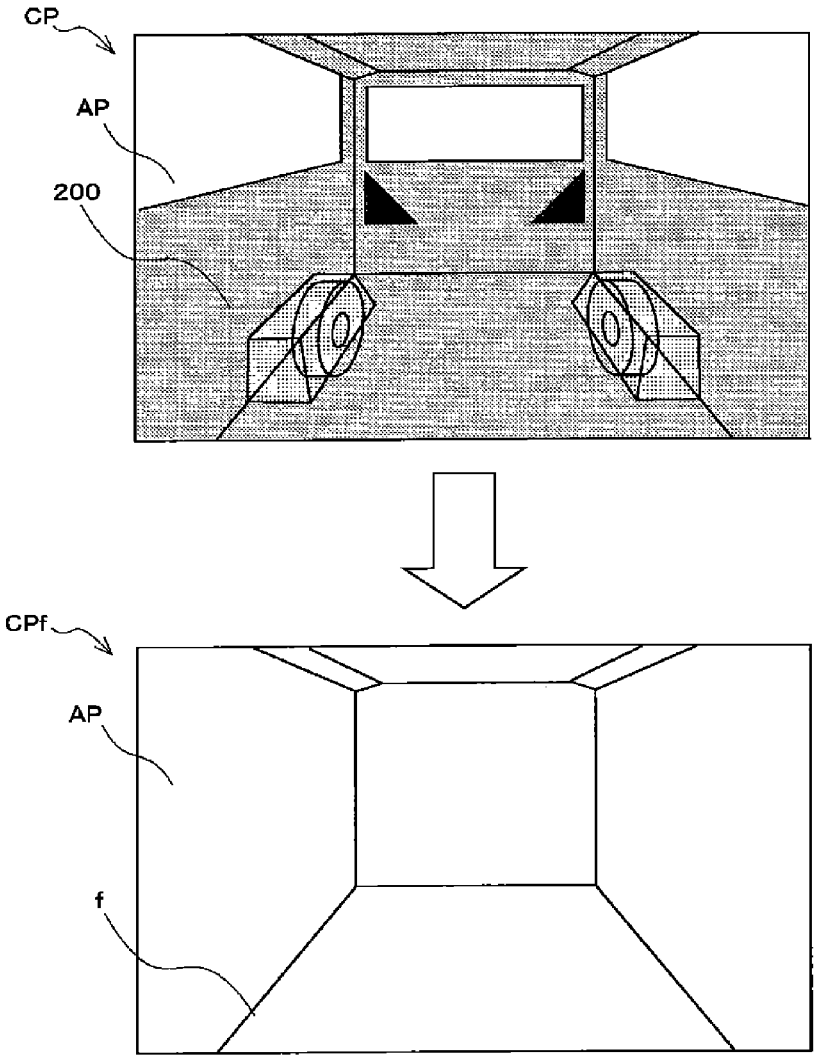
FIG. 21 shows an example of the transparency process.

FIG. 21 illustrates the display mode of the "framed structure display of the vehicle external shape." An upper drawing of FIG. 21 is the combined image CP generated by superimposing the cabin image 200 on the surrounding image AP. Moreover, a lower drawing of FIG. 21 shows the framed structure display of the combined image CP.

In a case of the framed structure display of the vehicle external shape, the transparency percentage of the cabin image 200 is set at 100% and only the frame f of the vehicle 2 is displayed in lines as an outline of an external shape of the vehicle 2. Since the outline showing the external shape of the vehicle is not transparent on the cabin image 200, it is possible to see the surrounding image AP, except an overlap with the lines showing the external shape of the vehicle 2.

The external shape of the vehicle refers to an outline of the vehicle that is a most outer appearance of the vehicle viewed from an outside, i.e., an outer frame. The image transparency adjustor 32*c* displays the vehicle 2 in the framed structure by displaying the outer frame of the vehicle 2 in lines. By displaying the vehicle 2 in the framed structure, the user can recognize the surrounding image AP showing a broad area, understanding a position of the vehicle body displayed in the frame f. Therefore, the user does not have to see individual parts such as the tail lamps and tires so that the attention of the user is not distracted. Therefore, the user can concentrate on an obstacle and the like adjacent to the vehicle 2. The transparency percentage of the cabin image 200 is here set at 100%. However, a high transparency percentage, such as 90%, may be set instead of 100% of the transparency percentage. The transparency percentage may be any percentage as long as the user can clearly recognize the surrounding image AP showing the broad area.

Figure 22:
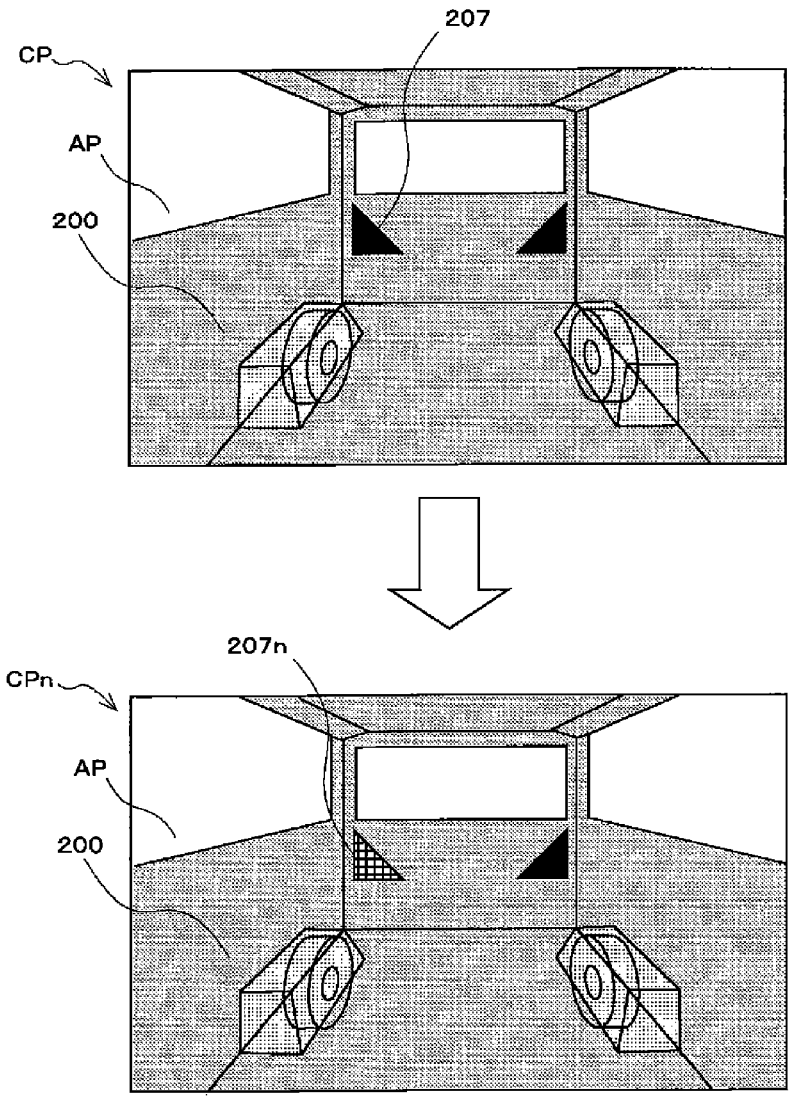
FIG. 22 shows an example of the transparency process.

FIG. 22 illustrates the display mode of the "mesh pattern display of tail lamps." An upper drawing of FIG. 22 is the combined image CP generated by superimposing the cabin image 200 including the tail lamp 207 on the surrounding image AP. Moreover, a lower drawing of FIG. 22 is a combined image CPn showing a tail lamp 207*n* that is the tail lamp 207 in a mesh pattern included in the cabin image 200. In other words, the image transparency adjustor 32*c* causes at least one of the plural parts of the cabin image 200 to be transparent in the mesh pattern.

When the tail lamp 207 is displayed in the mesh pattern, the user can see the surrounding image AP through the mesh pattern. The tail lamp 207 is usually displayed in red in the combined image CP. Thus, even if the transparency percentage of the tail lamp 207 is reduced; the user sees the surrounding image AP through the red tail lamp 207. In this case, since the user has to determine a color of an object located behind the tail lamp 207 through the red of the tail lamp 207, it is difficult for the user to determine the color of the object. Especially, if a lamp or another lighting system of a different vehicle or a traffic light is located behind the tail lamp 207 included in the surrounding image AP, the lamp or the light is overlapped with the red of the tail lamp 207 and is so unclear that the overlap may adversely affect a determination of the surrounding situation. Therefore, by the display of the tail lamp 207 in the mesh pattern, the user can understand the color of the surrounding image AP clearly and can determine the situation outside the vehicle accurately.

The tail lamp is displayed in the mesh pattern here. However, a part other than the tail lamp may be displayed in a mesh pattern. Moreover, it is recommended that a part having higher chroma, as compared to chroma of other parts, should be displayed in the mesh pattern because the part having higher chroma makes colors of the surrounding image AP difficult to be determined.

Figure 23:
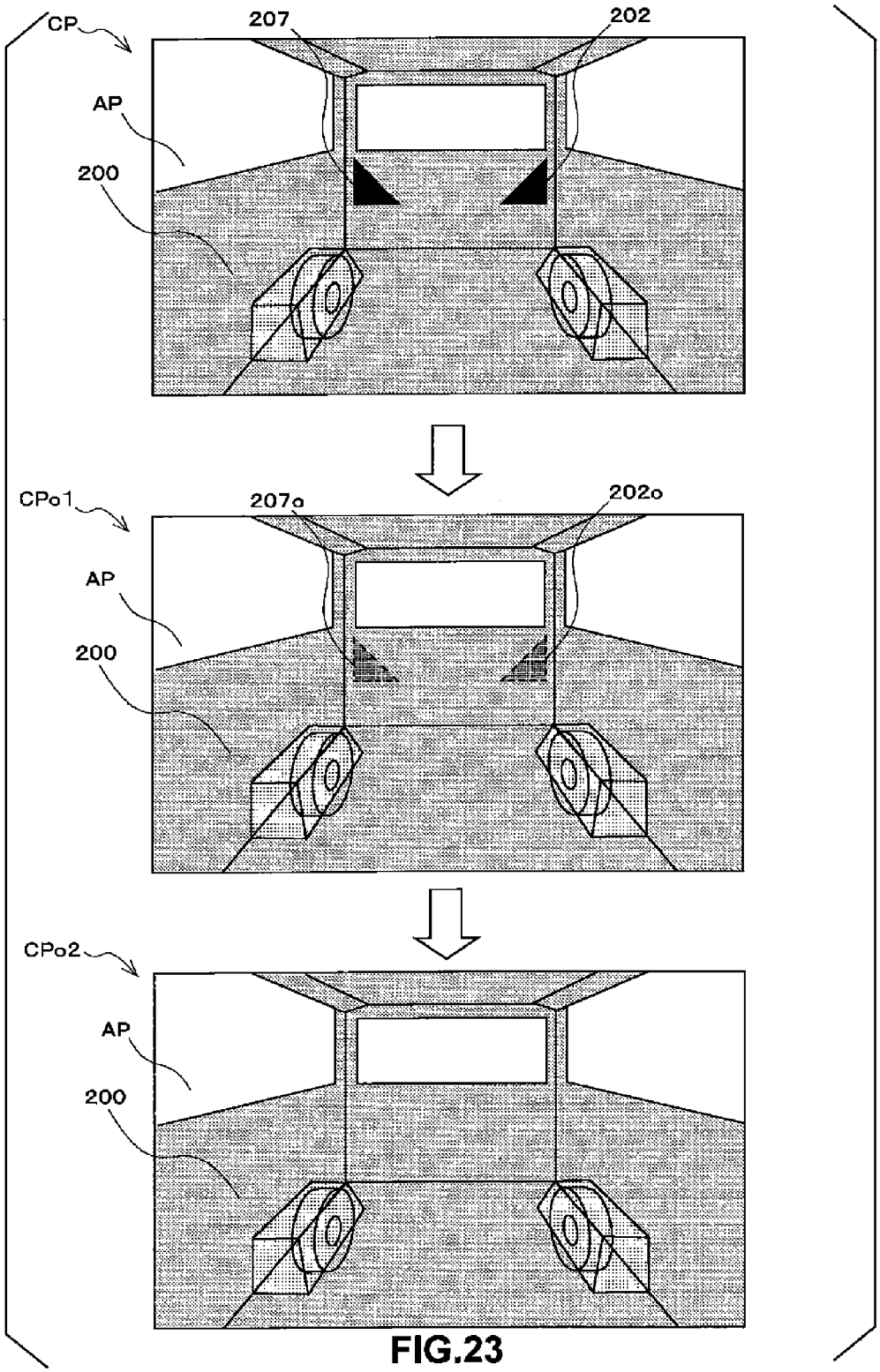
FIG. 23 shows an example of the transparency process.

FIG. 23 illustrates the display mode of the "no display of tail lamps." A top drawing of FIG. 23 is the combined image CP generated by superimposing the cabin image 200 including the right tail lamp 207 and the left tail lamp 202 on the surrounding image AP. A middle drawing of FIG. 23 is a combined image CPo1 showing the right tail lamp 207 and the left tail lamp 202 at increased transparency percentages. Moreover, a bottom drawing of FIG. 23 is a combined image CPo2 showing the right tail lamp 207 and the left tail lamp 202 at the transparency percentages of 100%.

When no display of tail lamps is selected via the display mode setting screen S1, the combined image CP is displayed on the display apparatus 4 and then the tail lamps are gradually faded out (a tail lamp 207*o* and a tail lamp 202*o*) by a gradual increase of the transparency percentages of the right tail lamp 207 and the left tail lamp 202. When the transparency percentages of the tail lamps are increased to reach 100%, the tail lamps are not displayed completely (erased).

By the no display of the tail lamps, the user can see the surrounding image AP more clearly. In other words, when the back side of the vehicle is displayed, the tail lamps are displayed around a center area of the display apparatus 4. Therefore, even if the transparency percentages of the tail lamps are increased, the tail lamps are overlapped with the surrounding image AP displayed around the center area of the display apparatus 4 that the user desires to see. Thus, it may be difficult for the user to recognize an obstacle and the like. Therefore, by the gradual fade-out of the tail lamps, the user can clearly recognize the surrounding image AP. Moreover, since the tail lamps are gradually faded out, even after the tail lamps are erased, the user can remember originally displayed positions of the tail lamps. Therefore, it is easier for the user to understand the obstacle and the like adjacent to the vehicle 2.

As described above, the display of the tail lamps is faded out gradually. However, after the tail lamps are erased, the transparency percentages of the tail lamps may be gradually decreased to display the tail lamps again. Since positions of the tail lamps may serve as a reference to measure a height of the vehicle, by displaying the tail lamps again, it becomes easier for the user to understand a positional relationship between the vehicle 2 and an object located in the surroundings. In this case, it is recommended that a time interval between erasing and redisplaying the tail lamps should be set relatively long, for example, 10 seconds. If a relatively short interval, for example, two seconds or less, is set, the tail lamps displayed in the center area of the display apparatus 4 stand out, and it is more difficult for the user to see the surrounding image AP.

Figure 24:
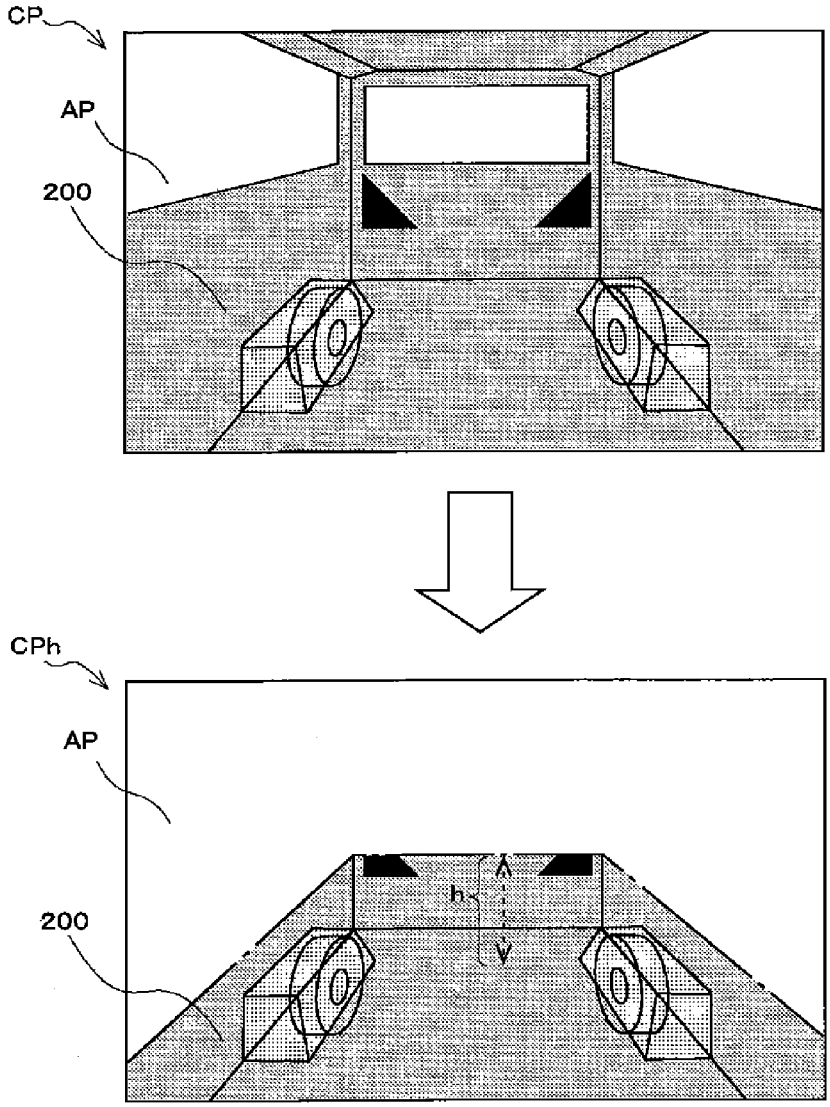
FIG. 24 shows an example of the transparency process.

FIG. 24 illustrates the display mode of the "no display of an upper portion of the vehicle." An upper drawing of FIG. 24 is the combined image CP generated by superimposing the cabin image 200 on the surrounding image AP. A lower thawing of FIG. 24 is a combined image CPh showing a portion of the vehicle 2 higher than a height h, among the plural portions of the cabin image 200, in a transparent form, i.e. at 100% of the transparency percentage.

When the display mode of the no display of the upper portion of the vehicle is selected via the display mode setting screen S1, the image transparency adjustor 32*c* sets the transparency percentage of the portion of the cabin image 200 higher than the height h at 100%. Thus, the user can recognize the surroundings of the vehicle 2 more widely, understanding the position of the vehicle via a portion lower than the height h on the image.

The height h is, for example, as a same height as a waist of an upstanding person who may be a driver of the vehicle 2. When looking at the surroundings of the vehicle 2, by the erasing of the portion of the cabin image 200 higher than the waist, the user can widely recognize the surroundings of the vehicle 2 higher than the waist, understanding the position of the vehicle via the portion lower than the waist on the image.

As described above, the image processing apparatus in this embodiment determines the individual transparency percentages of the plural portions of the cabin image 200 and causes the plural portions to be displayed at the individual transparency percentages. Thus, the user can intuitively understand the positional relationship between an object in the surrounding area and the vehicle 2.

Moreover, since the image processing apparatus displays a predetermined portion of the cabin image 200 at an increased transparency percentage as compared to another portion, the attention of the user can be draw to the portion displayed at the increased transparency percentage. Thus, the user can drive more safely.

Further, since the user sees the surrounding image AP through the cabin image 200, as compared with a case where the surrounding image AP is only displayed, the user can immediately recognize a direction displayed on the display apparatus 4.

2. Modifications

The embodiment of the invention is described above. However, the invention is not limited to the embodiment, and various modifications are possible. Examples of the modifications of the invention are described below. The embodiment described above and all forms including the modifications below may be arbitrarily combined.

In the embodiment described above, the combined image CP viewed from the driver seat viewpoint is displayed on the entire display apparatus 4. However, the display apparatus 4 may display the combined image CP viewed from the driver seat viewpoint and an overhead view image looked down from above the vehicle 2, side by side.

Figure 25:
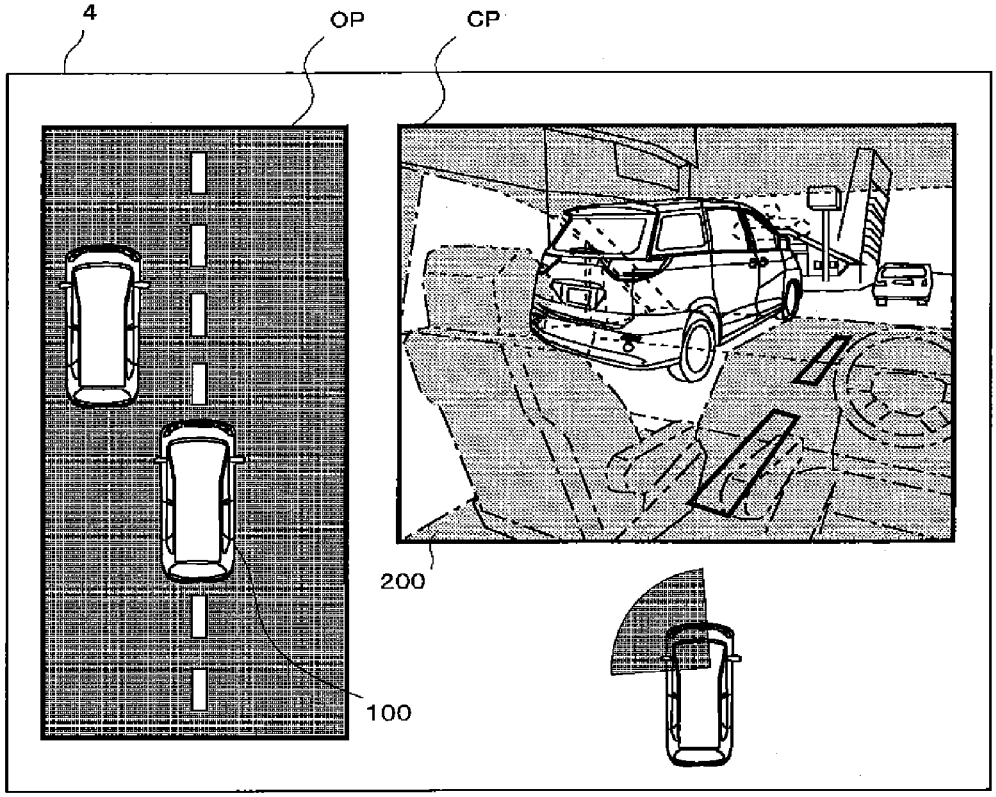
FIG. 25 shows an example of displayed images.

FIG. 25 illustrates an example where a combined image CP viewed from a driver seat viewpoint and an overhead view image OP are displayed on a display apparatus 4 side by side. On the overhead view image OP, a vehicle body image 100 is displayed on a substantially center area of the overhead view image OP. Thus, the user can see surroundings of a vehicle 2 viewed from above the vehicle 2, widely. Moreover, the combined image CP viewed from the driver seat viewpoint is displayed, including a cabin image 200 superimposed on the surrounding image AP, as described above. A part of parts, such as a left door panel; included in the cabin image 200 are displayed at an increased transparency percentage, as compared to transparency percentages of other parts. Thus, the user can more clearly understand a positional relationship between a host vehicle and another vehicle parked near the host vehicle via both the combined image CP viewed from the driver seat viewpoint and the overhead view image OP viewed from above the vehicle. Thus, the user can drive safely.

Moreover, in the embodiment described above, when an image is displayed at the transparency percentage set by the user, the transparency percentage is increased to the predetermined value, depending on the vehicle state or the surrounding situation. However, based on the transparency percentage set by the user, a new transparency percentage may be set. For example, the transparency percentage set by the user may be multiplied for a predetermined value.

Moreover, in the embodiment described above, the cabin image 200 is caused to be transparent. However, the vehicle body image 100 may be transparent. In this case, a virtual viewpoint should be set outside the vehicle.

In the embodiment described above, the virtual viewpoint is located at an arbitrary position in an arbitrary view direction in the virtual 3-D space. In a case of one camera, a position and a view direction of the camera may be the position and the view direction of a virtual viewpoint.

Moreover, in the embodiment described above, an example of an image including the vehicle image caused to be transparent, viewed from the driver seat viewpoint. However, during display of both an image viewed from the driver seat viewpoint and an overhead view image, the image viewed from the driver seat viewpoint may be changed over between an image having a transparent portion and an image having no transparent portion. In this case, during the display of both the image viewed from the driver seat viewpoint and the overhead view image, when the user presses a change-over button, the image having the transparent portion is changed to an image having no transparent portion, and vice versa. In other words, in a case where the driver seat viewpoint (VPa or VPb in FIG. 7) has been selected as the virtual viewpoint, the position of the overhead viewpoint (VPc in FIG. 7) is selected as a position of a new virtual viewpoint.

Contrarily, in a case where the overhead viewpoint has been selected, the driver seat viewpoint is selected as a new virtual viewpoint, and then the viewpoints may be changed in order based on a user instruction. In a case where a side-by-side image where the overhead view image and the image viewed from the driver seat viewpoint are displayed side by side is displayed, the image viewed from the driver seat viewpoint, the overhead view image and the side-by-side image may be displayed in order.

In the embodiment described above, the various functions are implemented by software using the CPU executing the arithmetic processing in accordance with the program. However, a part of the functions may be implemented by an electrical hardware circuit. Contrarily, a part of functions executed by hardware may be implemented by software.

What is claimed is:

1. An image processing apparatus configured to be used on a vehicle, the image processing apparatus comprising:

(a) an image processor configured to:

(i) generate a surrounding image showing a surrounding region of the vehicle viewed from a virtual viewpoint located in the vehicle, by using an image captured by a camera mounted on the vehicle;

(ii) obtain a vehicle image that is divided into plural portions showing the vehicle viewed from the virtual viewpoint;

(iii) generate a combined image by combining the surrounding image and the vehicle image having the plural portions; and (iv) output the combined image for display on a display apparatus, and (b) a controller configured to determine a transparency percentage of each of the plural portions of the vehicle image, wherein the image processor causes the plural portions to be semi-transparent or to be transparent at the determined transparency percentages such that the combined image includes the surrounding image and the vehicle image having the plural portions caused to be semi-transparent or to be transparent at the determined transparency percentages, wherein the plural portions include parts that are of a cabin of the vehicle and are physically independent of one another, wherein a list of the parts of which the transparency percentages are settable is displayed on a transparency percentage setting screen, wherein a user enters an arbitrary transparency percentage for each of the parts to the transparency setting screen, wherein the parts that are physically independent of each other are each individually selectable and the transparency percentage setting screen includes a list of the plural portions each individually selectable, and wherein the controller is further configured to perform at least one of: as a speed of the vehicle becomes higher, increasing the transparency percentage of a portion corresponding to a higher portion of the vehicle, among the plural portions and as a speed of the vehicle becomes lower, increasing the transparency percentage of a portion corresponding to a lower portion of the vehicle, among the plural portions.

2. The image processing apparatus according to claim 1, wherein the plural portions overlap each other when the surrounding region is viewed from the virtual viewpoint.

3. The image processing apparatus according to claim 1, wherein the plural portions include at least one of a tail lamp, a headlamp, a tire and a wheel housing.

4. The image processing apparatus according to claim 1, wherein the virtual viewpoint is a viewpoint looking rearward of the vehicle from an inside of the vehicle, and the plural portions include an outline showing a shape of the vehicle, a tail lamp and a tire.

5. The image processing apparatus according to claim 1, wherein the image processor does not cause an outline showing a shape of the vehicle to be transparent.

6. The image processing apparatus according to claim 1, wherein the image processor causes a portion higher than a predetermined height of the vehicle to be transparent, among the plural portions.

7. The image processing apparatus according to claim 1, wherein the image processor causes the plural portions to be semi-transparent in a mesh pattern.

8. The image processing apparatus according to claim 1, wherein the image processor gradually increases the determined transparency percentages of the plural portions.

9. The image processing apparatus according to claim 8, wherein after gradually increasing the determined transparency percentages of the plural portions, the image processor gradually decreases the determined transparency percentages of the plural portions.

10. The image processing apparatus according to claim 1, wherein the controller determines the transparency percentages based on a vehicle state of the vehicle.

11. The image processing apparatus according to claim 1, further comprising a speed obtaining part that obtains the speed of the vehicle, wherein the controller determines the transparency percentages based on the obtained speed of the vehicle.

12. The image processing apparatus according to claim 1, further comprising a rotation direction sensor that senses an operated direction of a steering wheel included in the vehicle, wherein the controller determines the transparency percentages based on a sensed rotated direction of the steering wheel.

13. The image processing apparatus according to claim 1, wherein the controller determines the transparency percentages based on an operation status of a turn-signal of the vehicle.

14. The image processing apparatus according to claim 1, further comprising an obstacle detector that detects a position of an object located adjacent to the vehicle, wherein the controller determines the transparency percentages based on the detected position of the object.

15. An image processing method that is used in a vehicle, the image processing method executed by an image processor and comprising the steps of:

generating a surrounding image showing a surrounding region of the vehicle viewed from a virtual viewpoint located in the vehicle, by using an image captured by a camera mounted on the vehicle;

obtaining a vehicle image that shows the vehicle viewed from the virtual viewpoint; dividing the vehicle image into plural portions, and causing the plural portions to be semi-transparent or to be transparent at determined transparency percentages for each of the plural portions;

generating a combined image by combining the surrounding image and the vehicle image having the plural portions caused to be semi-transparent or to be transparent;

outputting the combined image for display on a display apparatus, wherein the plural portions include parts that are of a cabin of the vehicle and are physically independent of one another;

displaying, on a transparency setting screen, a list of the parts of which the transparency percentages are settable, wherein a user enters an arbitrary transparency percentage for each of the parts to the transparency setting screen, wherein the parts that are physically independent of each other are each individually selectable, and the transparency percentage setting screen includes a list of the plural portions each individually selectable, and performing, at least one of: as a speed of the vehicle becomes higher, increasing the transparency percentage of a portion corresponding to a higher portion of the vehicle, among the plural portions and as a speed of the vehicle becomes lower, increasing the transparency percentage of a portion corresponding to a lower portion of the vehicle, among the plural portions.

16. An image processing system configured to be used in a vehicle, the image processing system comprising:

the image processing apparatus according to claim 1, and the display apparatus that displays the combined image output by the image processing apparatus.

* * * * *